US010086602B2

(12) United States Patent
Vilas Boas et al.

(10) Patent No.: US 10,086,602 B2
(45) Date of Patent: Oct. 2, 2018

(54) METHOD AND APPARATUS FOR PRINTING METALLIC BEVERAGE CONTAINER BODIES

(71) Applicant: Rexam Beverage Can South America S.A., Rio de Janeiro (BR)

(72) Inventors: Joao Andre Vilas Boas, Rio de Janeiro (BR); Carlos Eduardo Pires, Rio de Janeiro (BR)

(73) Assignee: REXAM BEVERAGE CAN SOUTH AMERICA, Rio de Janeiro (BR)

( * ) Notice: Subject to any disclaimer, the term of this patent is extended or adjusted under 35 U.S.C. 154(b) by 0 days.

(21) Appl. No.: 14/537,594

(22) Filed: Nov. 10, 2014

(65) Prior Publication Data

US 2016/0129687 A1 May 12, 2016

(51) Int. Cl.
*B41F 17/00* (2006.01)
*B41F 13/193* (2006.01)
(Continued)

(52) U.S. Cl.
CPC ..... *B41F 17/22* (2013.01); *B41M 1/06* (2013.01); *B41M 1/08* (2013.01); *B41M 1/20* (2013.01); *B41M 1/40* (2013.01); *B41F 17/006* (2013.01)

(58) Field of Classification Search
CPC ..... B41F 5/22; B41F 17/006; B41F 13/193; B41F 17/08; B41F 17/22; B41F 17/14; B41F 17/20
See application file for complete search history.

(56) References Cited

U.S. PATENT DOCUMENTS 3,252,410 A 5/1966 Stephenson
3,286,302 A 11/1966 Doering
(Continued)

FOREIGN PATENT DOCUMENTS

CA 2097619 5/1992
CN 101808825 8/2010
(Continued)

OTHER PUBLICATIONS

European Patent Office acting as International Searching Authority, International Search Report dated Apr. 24, 2015 in PCT/IB2014/002904.

(Continued)

*Primary Examiner* — R. A. Smith
*Assistant Examiner* — John M Royston
(74) *Attorney, Agent, or Firm* — Greer, Burns & Crain, Ltd.

(57) ABSTRACT

A pair of metallic beverage container bodies is sequentially decorated in a direct single file queue by a dry offset rotary metallic beverage container decorator. A container body has a common design element, a first unique design element in a first color, and a second unique design element in a second color on its outer surface. The first unique design element is located within a boundary of the second unique design element. A second container body has the common design element, a third unique design element in the first color, and a fourth unique design element in the second color on the outer surface. The third unique design element is unique relative to the first and second design elements. The third unique design element is located within a boundary of the fourth unique design element.

17 Claims, 33 Drawing Sheets

(51) Int. Cl.

| | |
|---|---|
| ***B41F 17/08*** | (2006.01) |
| ***B41F 17/22*** | (2006.01) |
| ***B41F 17/20*** | (2006.01) |
| ***B41M 1/20*** | (2006.01) |
| ***B41M 1/40*** | (2006.01) |
| ***B41M 1/06*** | (2006.01) |
| ***B41M 1/08*** | (2006.01) |

(56) References Cited

U.S. PATENT DOCUMENTS 3,752,073 A 8/1973 Lorber
3,766,851 A 10/1973 Sirvet et al.
3,960,073 A 6/1976 Rush
3,991,673 A 11/1976 Coale et al.
4,048,917 A 9/1977 Skrypek et al.
4,132,826 A 1/1979 Dessauer et al.
4,142,462 A 3/1979 Gilore
4,384,518 A 5/1983 Albin
4,395,946 A 8/1983 Price
4,471,011 A 9/1984 Spöring
4,479,429 A 10/1984 Haryu
4,519,310 A 5/1985 Shimizu et al.
4,589,339 A 5/1986 Fischer
4,741,266 A 5/1988 Stirbis et al.
4,884,504 A 12/1989 Sillars
4,889,560 A 12/1989 Jaeger et al.
4,898,752 A 2/1990 Cavagna et al.
4,903,599 A 2/1990 Kulber et al.
5,010,814 A 4/1991 Shishikura
5,049,432 A 9/1991 Ooms et al.
5,181,471 A * 1/1993 Sillars ..... B41F 11/00 101/217
5,213,043 A 5/1993 Reimers et al.
5,282,306 A 2/1994 Katsuhiro
5,337,659 A 8/1994 Whelan
5,339,731 A 8/1994 Howard et al.
5,351,617 A 8/1994 Williams et al.
5,353,703 A 10/1994 Rieker
5,385,092 A 1/1995 Lewis et al.
5,469,787 A 11/1995 Turner et al.
5,502,476 A 3/1996 Neal et al.
5,591,255 A 1/1997 Small et al.
5,713,288 A 2/1998 Frazzitta
5,771,798 A 6/1998 Shriver
5,806,427 A 9/1998 Niemiro et al.
5,908,505 A 6/1999 Bargenquest et al.
5,919,839 A 7/1999 Titterington et al.
5,970,865 A 10/1999 Horth et al.
5,974,974 A 11/1999 Agnew et al.
6,037,101 A 3/2000 Telser et al.
6,058,839 A 5/2000 Frazzitta
6,079,326 A 6/2000 Strutz et al.
6,139,779 A 10/2000 Small et al.
6,174,937 B1 1/2001 Banning et al.
6,196,675 B1 3/2001 Deily et al.
6,238,837 B1 5/2001 Fan
6,309,453 B1 10/2001 Banning et al.
6,312,872 B1 11/2001 Murphy
6,395,123 B1 5/2002 Fromson et al.
6,494,950 B1 12/2002 Fujita et al.
6,543,350 B2 4/2003 Gilliam et al.
6,550,389 B1 4/2003 Goto et al.
6,553,907 B2 4/2003 Richards
6,584,895 B1 7/2003 Strauch et al.
6,594,927 B2 7/2003 Witkowski
6,640,713 B2 11/2003 Landsman
6,651,559 B2 11/2003 Haraux et al.
6,779,445 B2 8/2004 Schaede
6,779,455 B2 8/2004 Figov et al.
6,827,019 B1 12/2004 Hieronymus et al.
6,899,998 B2 5/2005 Figov
6,920,822 B2 7/2005 Finan
6,989,226 B2 1/2006 Araki et al.
7,309,563 B2 12/2007 Paul et al.
7,399,526 B2 7/2008 Dalmais et al.
7,464,642 B2 12/2008 Schaede
7,691,549 B1 4/2010 Glasser
7,810,922 B2 10/2010 Gervasi et al.
7,997,199 B2 8/2011 Watanabe et al.
8,034,207 B2 10/2011 Hunahata
8,409,698 B2 4/2013 Byers et al.
8,544,385 B2 10/2013 Schuler-Cossette et al.
9,409,433 B2 8/2016 Carreras
9,475,276 B2 10/2016 Fleischer et al.
9,555,616 B2 1/2017 Carreras et al.
2002/0083855 A1 4/2002 Samworth
2002/0178945 A1 12/2002 Richards
2002/0189471 A1 12/2002 Juffinger et al.
2003/0015105 A1 1/2003 Dewig
2003/0056410 A1 3/2003 Witkowski
2003/0089261 A1 5/2003 Landsman
2003/0101885 A1 6/2003 Jordan
2003/0150346 A1 8/2003 Haraux et al.
2004/0011234 A1 1/2004 Figov et al.
2004/0126682 A1 7/2004 Dreher et al.
2004/0173110 A1 9/2004 Roesch
2004/0191693 A1 9/2004 Takamiya
2005/0098051 A1 5/2005 Flint et al.
2006/0019196 A1 1/2006 Miyoshi
2007/0084368 A1 4/2007 Vest et al.
2009/0186308 A1 7/2009 Rudolph
2009/0303307 A1 12/2009 Yasumatsu
2010/0031834 A1 2/2010 Morgavi et al.
2010/0229737 A1 9/2010 Ouchi
2010/0295885 A1 11/2010 LaCaze
2010/0319555 A1 12/2010 Hashimoto et al.
2011/0104615 A1 5/2011 Sievers
2011/0126760 A1 6/2011 Daems et al.
2011/0162542 A1 7/2011 Nakamura et al.
2011/0255134 A1 10/2011 Shigeta et al.
2011/0283905 A1 11/2011 Sakata
2012/0048135 A1 3/2012 Burberry et al.
2012/0103216 A1 5/2012 Knisel et al.
2012/0204746 A1 8/2012 Fullgraf
2012/0238675 A1 9/2012 Kataura et al.
2012/0272846 A1* 11/2012 Fleischer ..... B41F 17/22 101/38.1
2012/0274695 A1 11/2012 LaCaze et al.
2012/0315412 A1 12/2012 Clayton et al.
2013/0019566 A1 1/2013 Schach
2013/0075675 A1 3/2013 Krutak et al.
2013/0105743 A1 5/2013 Owen et al.
2013/0176358 A1 7/2013 Yamada et al.
2013/0228086 A1 9/2013 Baldwin et al.
2013/0231242 A1 9/2013 Clayton et al.
2013/0242276 A1 9/2013 Schadebrodt et al.
2013/0340885 A1 12/2013 Clayton et al.
2014/0039091 A1 2/2014 Owen et al.
2014/0072442 A1 3/2014 Bowman et al.
2014/0187668 A1 7/2014 Owen et al.
2014/0210201 A1 7/2014 Owen et al.
2014/0212654 A1 7/2014 Clayton et al.
2014/0272161 A1 9/2014 Clayton et al.
2014/0299009 A1* 10/2014 Miller ..... B41F 17/005 101/36
2015/0174891 A1 6/2015 Boas et al.
2015/0183211 A1 7/2015 Petti et al.
2015/0290923 A1 10/2015 Treloar
2016/0001546 A1* 1/2016 Hughes ..... B41F 17/22 101/38.1
2016/0129687 A1 5/2016 Boas et al.
2016/0347048 A1 12/2016 Carreras
2017/0013452 A1 4/2017 Boas et al.
2018/0009216 A1 1/2018 Egerton et al.

FOREIGN PATENT DOCUMENTS

CN 102143846 8/2011
CN 103109233 5/2013
DE 102006025897 1/2007
EP 202928 11/1986
EP 545862 6/1993
EP 0641648 A1 3/1995

(56) References Cited

FOREIGN PATENT DOCUMENTS

| | | | |
|---|---|---|---|
| EP | 0717320 | | 6/1996 |
| EP | 1262316 | A1 | 12/2002 |
| EP | 1630600 | A2 | 3/2006 |
| EP | 2153991 | | 2/2010 |
| EP | 2196314 | A1 | 6/2010 |
| EP | 2317387 | | 5/2011 |
| EP | 2384890 | | 11/2011 |
| EP | 2842747 | A1 | 3/2015 |
| GB | 1298205 | | 11/1972 |
| GB | 2097331 | A | 11/1982 |
| GB | 2504370 | A | 1/2014 |
| GB | 2512678 | | 10/2014 |
| JP | 1997039366 | A | 2/1997 |
| JP | 2000-258899 | | 9/2000 |
| JP | 2001/030612 | | 2/2001 |
| JP | 2007/076209 | | 3/2007 |
| KR | 10-2006-0004679 | | 1/2006 |
| WO | 1990/02044 | | 3/1990 |
| WO | 9209435 | A1 | 6/1992 |
| WO | 94/07693 | | 4/1994 |
| WO | 98/17474 | | 4/1998 |
| WO | 98/41966 | | 9/1998 |
| WO | 00/27644 | | 5/2000 |
| WO | 2004069539 | | 8/2004 |
| WO | 2005023545 | A2 | 3/2005 |
| WO | 2005047011 | | 5/2005 |
| WO | 2006048022 | A2 | 5/2006 |
| WO | 2009/090389 | | 7/2009 |
| WO | 2012148576 | | 11/2012 |
| WO | 2013/028804 | | 2/2013 |
| WO | 2013/115800 | | 8/2013 |
| WO | 2013113616 | | 8/2013 |
| WO | 2013/155423 | | 10/2013 |
| WO | 2014/008544 | | 1/2014 |
| WO | 2014006517 | A1 | 1/2014 |
| WO | 2014/096088 | | 6/2014 |
| WO | 2014108489 | | 7/2014 |
| WO | 2014128200 | A2 | 8/2014 |
| WO | 2014/144853 | | 9/2014 |
| WO | 2015101828 | A1 | 7/2015 |
| WO | 2016/183452 | | 11/2016 |
| WO | 2018013465 | A1 | 1/2018 |

OTHER PUBLICATIONS

European Patent Office acting as International Searching Authority, International Search Report dated Sep. 13, 2013 in PCT/IB2013/051746.

European Patent Office acting as International Searching Authority, Written Opinion dated Apr. 24, 2015 in PCT/IB2014/002904.

European Patent Office acting as International Searching Authority, Written Opinion dated Sep. 13, 2013 in PCT/IB2013/051746.

Third Party Observations submitted on Oct. 21, 2014 in PCT/IB2013/051746.

United Kingdom Intellectual Property Office, Search Report dated May 14, 2013 in GB Application No. GB1303937.5.

United Kingdom Intellectual Property Office, Examination Report dated May 14, 2013 in GB Application No. GB1303937.5.

United Kingdom Intellectual Property Office, Second Examination Report dated Aug. 13, 2014 in GB Application No. GB1303937.5.

United Kingdom Intellectual Property Office, Third Examination Report dated Jul. 13, 2015 in GB Application No. GB1303937.5.

Third Party Observations submitted on Mar. 10, 2014 in UKIPO Application No. GB1303937.5.

Third Party Observations submitted on Jul. 4, 2014 in UKIPO Application No. GB1303937.5.

Third Party Observations submitted on Feb. 12, 2015 in UKIPO Application No. GB1303937.5.

European Patent Office acting as International Searching Authority, International Search Report dated Aug. 3, 2016 in PCT/IB2015/002071.

"Blanket for Offset Printing," Offset printing technology, 2016, 4 pages [retrieved from: www.offsetprintingtechnology.com.sub-categories/blanket-for-offset-printing/].

Bowell et al., "Advancing Flexography: The Technical Path Forward," DuPont, 2011, retrieved from www2.dupont.com/packaging_graphics/en_us/assets/downloads/pdf/advflexo_brochure.pdf, 12 pages.

"Chemical Milling," Wikipedia, Feb. 13, 2015, retrieved from http://en.wikipedia.org/wiki/chemical_milling, 6 pages.

"Cyrel® DSP High Performance Plate," DuPont, 2016, 2 pages [retrieved online from: www.dupont.com/products-and-services/printing-package-printing/flexographic-platemaking-systems/brands/cyrel/products/sub-products/cyrel-dsp.html].

Corrected Notice of Allowance for U.S. Appl. No. 14/686,517, dated Sep. 28, 2016 6 pages.

"Dry Offset Printing," Encyclopedia Britannica, 2016, 2 pages [retrieved online from: www.britannica.com/technology/dry-offset].

"DuPont™ Cyrel®: CyrelTM Digital flex plate Imagers (CDI)" DuPont, 2009, retrieved from http://www2.dupont.com/packaging_graphics/en_gb/assets/downloads/pdf/CDI_family_english.pdf, 8 pages.

"DuPont™ Cyrel® DPR: Robust Digital Plate for Highest Quality Printing," DuPont 2010, retrieved from http://www2.dupont.com/packaging_graphics/en_us/assets/downloads/pdf/DP_Cyrel_DS_DPR_us_low.pdf., 2 pages.

"DuPont™ Cyrel® NOWS: Rugged, High-Performance Analog Plate," DuPont, 2007, retrieved from http:www2.dupont.com/packaging_graphics/en_us/assests/downloads/pdf/Cyrel_NOWS.pdf, 2 pages.

"EPDM Rubber," Wikipedia, Oct. 24, 2014, retrieved from http://enwikipedia.org/wiki/EPDM_rubber, 3 pages.

Extended Search Report for European Patent Applicatoin No. 14810948.1, dated Apr. 11, 2017 10 pages.

"Flexographic Ink," Wikipedia, Sep. 18, 2014, retrieved from http://en.wikipedia.org/wiki/flexographic_ink, 2 pages.

"Flexography," Wikipedia, Dec. 15, 2014, retrieved from http://en.wikipedia.org/wiki/flexorgraphic, 6 pages.

International Preliminary Report on Patentability for International (PCT) Patent Application No. PCT/US2014/041713, dated Dec. 15, 2015 6 pages.

International Preliminary Report on Patentability for International (PCT) Patent Application No. PCT/US2016/027576, dated Jul. 22, 2016 6 pages.

International Search Report and Written Opinion for International (PCT) Patent Application No. PCT/US16/27576, dated Jul. 22, 2016 5 pages.

International Search Report and Written Opinion for International (PCT) Patent Application No. PCT/US14/41713, dated Oct. 10, 2014 8 pages.

"Laser Engraving," Wikipedia, Jan. 16, 2015, retrieved from http://en.wikipedia.org/wiki/laser_engraving, 10 pages.

"Luminous Paint," Wikipedia, Jul. 7, 2014, retrieved from http://en.wikipedia.org/wiki/luminous_paint, 4 pages.

Mine, "How Offset Printing Works," retrieved on Feb. 9, 2015 from www.howstuffworks.com/offset-printing.htm/printable, 5 pages.

Notice of Allowance for U.S. Appl. No. 14/301,018, dated Apr. 6, 2016 10 pages.

Notice of Allowance for U.S. Appl. No. 15/231,128, dated Jan. 5, 2018 8 pages.

Notice of Allowance for U.S. Appl. No. 14/686,517, dated Sep. 13, 2016 9 pages.

Official Action for U.S. Appl. No. 14/301,018, dated Aug. 14, 2015 10 pages.

Official Action for U.S. Appl. No. 14/005,873, dated Aug. 26, 2015, 27 pages.

Official Action for U.S. Appl. No. 14/301,018, dated Dec. 15, 2015 8 pages.

Official Action for U.S. Appl. No. 14/686,517, dated Jan. 15, 2016 8 pages.

Official Action for U.S. Appl. No. 15/231,128, dated Jul. 13, 2017 8 pages.

Official Action for U.S. Appl. No. 14/686,517, dated Jul. 6, 2016 9 pages.

Official Action for U.S. Appl. No. 14/301,018, dated May 13, 2015 5 pages.

(56) References Cited

OTHER PUBLICATIONS

Official Action for U.S. Appl. No. 14/686,517, dated Oct. 15, 2015 5 pages Restriction Requirement.
"Offset Lithography," PrintWiki, retrieved Feb. 9, 2015 from http://printwiki.org/offset_lithography, 8 pages.
"Offset Printing," Wikipedia, Dec. 11, 2014, retrieved from http://en.wikipedia.org/wiki/offset_printing, 12 pages.
"Offset Printing," Offset Printing Technology, 2016, 4 pages [retrieved online from: www.offsetprintingtechnology.com].
"Offset Printing," BusinessDictionary.com, 2015, 2 pages [retrieved online from: www.businessdictionary.com/definition/offset-printing.html].
"Offset Printing/Dry Offset," Buse Printing & Packaging, 2016, 1 page [retrieved online from: buseprinting.com/offset_printing.html].
"Plate," PrintWiki, retrieved Feb. 9, 2015 from http://printwiki.org/Plate, 6 pages.
"Printmaking," Wikipedia, Feb. 12, 2015, retrieved from http://en.wikipedia.org/wiki/printmaking, 14 pages.
Third Party Observations for European Patent Application No. 14810948.1, dated Jan. 29, 2018 5 pages.
Third Party Observations for European Patent Application No. 14810948.1, dated Dec. 21, 2016 5 pages
"What is Offset Printing (Offset Lithography)?" TechTarget, 2016, 13 pages [retrieved online from: whatis.techtarget.com/definition/offset-printing-offset-lithography].

* cited by examiner

METHOD AND APPARATUS FOR PRINTING METALLIC BEVERAGE CONTAINER BODIES

TECHNICAL FIELD

The present invention relates to an apparatus for printing cans, especially aluminum beverage container bodies having more than one finished art on its surface. The invention also relates to a process for printing the respective can, as well as to the beverage container bodies obtained by this printing process.

BACKGROUND OF THE INVENTION

Modern metal beverage containers have printed designs and words on their exposed cylindrical sidewall. The words and designs generally consist of trademarks, trade dress, nutritional information, volume, and any other information that the metal beverage container manufacturer and the beverage manufacturers may want to communicate to consumers, competitors and others.

The most common printing type performed on metal beverage containers is the dry rotary offset-type which is made by a specific printer for this purpose. This type of printing enables one to apply a plurality of colors onto metallic metal beverage containers. Such printing is carried out on metal beverage container bodies during their manufacturing process. This process includes a sequence of cutting, cup forming, drawing and ironing, the printing itself and subsequent necking of the open end until the metal beverage container body reaches its final desired shape. The metal beverage container body is then filled with a beverage and a can lid is attached to the open end of the filled can body.

To better understand the field of the present invention, a prior art printing apparatus or a printer, as it is usually known, is illustrated in FIG. 1.

The apparatus 1 of FIG. 1 includes a plurality of components, wherein six ink cartridges 2*a*-2*f* are present. These cartridges 2*a*-2*f* are supplied with colored ink that is applied onto a cylindrical side wall of the metal beverage container body. The printing apparatus 1 is provided with an ink cartridge 2*a*-2*f* for each color that one wishes to apply onto the metal beverage container body. For example, if it is desired to print a metal beverage container with three colors, three of the six ink-cartridge 2*a*-2*f* should be supplied with the necessary corresponding colored ink. It should be noted that in this type of equipment, there is a limitation on the number of colors which can be applied to the metal beverage container that is dependent on the number of ink-cartridges available. In other words, if ten different colors are desired, it is necessary that the printing apparatus should have at least ten ink-cartridges 2*a*-2*f*.

The ink cartridges 2*a*-2*f* supply ink to printing plates 3*a*-3*f*, which have the finished art to be printed onto the metal beverage container. This finished art may be a text, a figure or any type of graphic which one wishes to make on a metal beverage container. Thus, it is very important to position the printing plate correctly relative to the metal beverage container and the ink cartridges 2*a*-2*f*. For this purpose, a printing plate, for example, 3*a*, which is generally produced from a magnetic material, has a precise alignment on a plate cylinder 4*a*.

This alignment or registration is achieved via guide-bores in the printing plate (not shown in the figure), which are aligned to guide-pins on the plate cylinder 4*a*. The plate cylinder is a substantially cylindrical body to which the printing plate is attached and rotates therewith. This is made possible as the outer surface of the plate cylinder is formed by a magnetic material that attracts the printing plate 3*a* and keeps it in the desired position.

It is also important to point out that the finished art present on the printing plate 4*a* is in relief, so that it transfers the ink supplied by the ink cartridge 2*a* to a transfer blanket 5*a*. This transfer blanket 5*a* is an ink transferring means between the printing plate 3*a* and the metal beverage container to be printed.

Thus, the relief on the printing plate 3*a* comes into contact with the transfer blanket 5*a*, transferring only the ink that is present thereon to the transfer blanket 5*a*. This is carried out by rotation of the printing plate 3*a*, which transfers the ink present in relief to the transfer blanket 5*a*, which is fixed on the transfer blanket drum 6, which has a rotation synchronized with (i) the metal beverage container bodies to be printed, (ii) the positioning of the transfer blankets 5*a*-51 that are on the surface of such a transfer blanket drum 6, and (iii) the printing plates 3*a*-3*f*.

The synchronization between aforementioned elements makes it possible to decorate the metal beverage container bodies in a quite precise manner. This is of the utmost importance in metal beverage container printing. There should be no overlapping of the print on the metal beverage container when it receives more than one finished art on its surface. In other words, the finished art of a first printing plate 3*a* will transfer ink only to a predetermined area of the transfer blankets 5*a*-5*l*, whereby a second printing plate 3*b*-3*f* will transfer ink only on its surface to another area on the transfer blankets 5*a*-5*l* that did not receive ink from the first printing plate 3*a*, and so on. This is dependent on the number of printing colors on the metal beverage containers. There is generally no overlap of inked areas on the finished. Thus, printing of an entire metal beverage container cylindrical surface without ink overlapping is possible using this type of rotary dry offset printing apparatus.

In this regard, it should be stressed that there is transfer of more than one finished art with a different color to one or more than one transfer blanket 5*a*-5*l* present on the transfer blanket drum 6 from the respective printing plates 3*a*-3*f* that are in communication with the respective ink-cartridges. Hence, upon continuous rotation of the transfer blanket drum, the blanket comes into contact with the metal beverage container cylindrical surface to be printed. Thus, each blanket fully decorates one metal beverage container body upon rotation of the drum.

It should be understood that each of the transfer blankets 5*a*-5*l* can receive, on its surface, a plurality of different colors coming from more than one printing plate 3*a*-3*f*, but the transfer blankets 5*a*-5*l* do not have any overlapping of finished art with different colors.

The metal beverage containers to be printed may be colorful, but when they are examined in detail, one can see that with this type of printing, there is no color overlapping. Despite the proximity of the different colors that are on the metal beverage container surface, there will always be a small space between the printing of different colors.

It is also important to note that, when one wishes to change the finished art present on the metal beverage containers that are being printed, it is necessary to interrupt the production, that is, the printing apparatus 1 would be necessarily stopped. Thus, production of metal beverage containers must be stopped. Such stoppage is necessary because there may be the need to change the printing color of the metal beverage container, or to change one product of metal beverage container to a different metal beverage container product.

For example, when one is carrying out a type of metal beverage container printing for Product A and wishes to begin printing metal beverage containers for Product B, the finished art will also change, and it is necessary to interrupt the printing process. In short, with the existing process and equipment, it is only possible to achieve one type of finished art printed on the metal beverage container with the same printing apparatus. If it is necessary or desired to change the print on the metal beverage container, the production will necessarily have to be interrupted, which for economic reasons should be minimized as much as possible.

This can be easily observed through the order or magnitude of metal beverage container printing, which is very significant. With the present-day pieces of equipment, one can print approximately 2.5 million metal beverage containers in a single day.

Thus, at present, there are a number of studies with a view to minimize, as far as possible, the stoppages of this type of equipment, so that the production will not be interrupted. It is noted that these stoppages are, as a rule, necessary, because the same production line is intended for cans with the most varied finished arts. For example, metal beverage containers intended for beer and metal beverage container intended for soft drinks are produced on the same printing machine.

In turn, in the face of the significant amount of production of metal beverage containers and the substantial printing speed, the metal beverage containers that have been printed are packed for delivery to beverage manufacturers. Then, as an example, when there is production of a given type of metal beverage container, the produced metal beverage containers are packed on pallets, wherein each of the pallets have about 6,000-15,000 units of printed metal beverage containers, all having identical print designs, that is, with the same finished art printed on them.

Thus, the metal beverage container manufacturers' customers, mainly companies that produce beverages, receive loadings of these pallets. The beverage companies fill the metal beverage containers with beverages and deliver them to wholesalers and retailers, as for example, super-markets. In other words, the supermarkets will also receive a large number of cans with beverages having the same finished art printed thereon.

FIG. 2 shows the size of a standard-pallet containing about 8,500 metal beverage containers. As one can see in this figure, there is a man of medium height beside the pallet that contains the metal beverage containers. From this, it is possible to have a quite significant idea of the number of metal beverage containers being produced by a production line (it should be repeated: 2.5 million cans a day). Following this understanding, one must understand the significant logistics present in the distribution and production of metal beverage containers of this type.

However, as set forth above, the same sequence of production of metal beverage containers has necessarily the same print arrangement, that is, the metal beverage containers are virtually identical.

If there is a desire to make metal beverage containers with different print arrangements, it is necessary, in the prior art, to interrupt the production line in order to change the printing plates 3*a*-3*f*.

In this regard, the beverage market is greatly influenced by the marketing of the companies of this business segment. Thus, the print arrangements or finished arts on metal beverage containers are considered extremely important to such companies. This is because the consumer is often influenced to buy a given product by the visual aspect brought by the print on the metal beverage containers.

This influence in the decision of the consumer has put more and more pressure on the marketing sectors of the beverage companies, because they require the launching of new and different print arrangements and designs. However, despite the efforts of these sectors, the can manufacturers have significant limitations in the ability to be flexible, namely due to the fact that the same type of metal beverage container produced in the same series (in the production of the can or in the packing of the product) necessarily has always the same finished art. This is not related to the limitation of the professionals involved in the creation of the layout or print arrangement of the metal beverage containers, but to the fact that the same production metal beverage container series without manufacturing interruption will necessarily have the same printed art.

More recently, as described in, a process for which enables manufacturers to print different finished arts onto sequentially, i.e. directly consecutively, produced cans has been introduced. This printing takes place without interruption of the production.

Using this method, it is possible to obtain, at the end of the can production line, pallets with different finished arts or print arrangements, i.e., instead of having the same sequence of can production with equal prints, it is possible to have cans with different print arrangements, which has a substantially significant commercial effect. This is because it is possible for the same commercial establishment to receive cans, containing the same product, but in cans which are different from each other.

This becomes very important because there is the possibility of a wide range of different creations for the marketing sectors of the companies that produce beverages. Thus, for instance, if there is a determined promotion or festivity of great magnitude, the disclosure of WO enables the production of cans from the same production series, i.e. sequentially and continuously manufactured without manufacturing interruption, to have different print arrangements, as for example cartoons, animal drawings, names of people, country names, or still of sports activities. In short, the print arrangements or finished arts may be of different kinds and depend basically on the respective creativity of the creator of cans, since in light of the present invention there is no longer any technical limit that requires the interruption of printing to provide cans with different print arrangements or finished arts from the same uninterrupted sequence of production.

The present invention is provided to solve the problems discussed above and other problems, and to provide improvements, advantages and aspects not provided by prior apparatuses of this type. A full discussion of the features and advantages of the present invention is deferred to the following detailed description, which proceeds with reference to the accompanying drawings.

SUMMARY OF THE INVENTION

A first disclosure is directed to a plurality of metallic beverage container bodies directly consecutively decorated in a single file queue by a dry offset rotary metallic beverage container decorator without manufacturing interruption. The metallic beverage containers are substantially identical, as in within typical manufacturing tolerance. A first metallic beverage container body comprises an open end separated from a closed end by a circumferential side wall having an inner surface and an opposing outer surface. A common design element is located on the outer surface. A first unique design element is in a first color on the outer surface and is defined by a first unique design element surface area. A second unique design element in a second color is also located on the outer surface and is defined by a second unique design element surface area. The first unique design element surface area is located within the second unique design element surface area. A second metallic beverage container body also comprises an open end separated from a closed end by a circumferential side wall having an inner surface and an opposing outer surface. The common design element is located on the outer surface. A third unique design element in the first color is located on the outer surface and is defined by a third unique design element surface area. The third unique design element is unique relative to the first and second design elements on the first metallic beverage container body. A fourth unique design element is in the second color and located on the outer surface and is defined by a fourth unique design element surface area. The third unique design element surface area is located within the fourth unique design element surface area. The fourth unique design element is unique relative to the first and second design elements on the first metallic beverage container body.

This disclosure may optionally include one or more of the following characteristics, alone or in any reasonable combination. The first and third unique design element surface areas may be located completely within boundaries of the second and fourth unique design element surface areas, respectively. The first and third unique design element surface areas may be substantially equal to the second and fourth unique design element surface areas, respectively. The first and third unique design element surface areas may be greater than the second and fourth unique design element surface areas, respectively. The first and third unique design element surface areas may be less than the second and fourth unique design element surface areas, respectively. The first and third unique design elements may be alphanumeric characters. The second and fourth unique design elements may be alphanumeric characters. The first unique design element may be the same alphanumeric character as the second unique design element. The third unique design element may be the same alphanumeric character as the fourth unique design element. The second and fourth design elements may each take the color of an uninked outer surface of the first and second metallic beverage container bodies. The first and third design elements may each take a color of an ink supplied to the outer surface of the first and second metallic beverage container bodies. The common design element is identical on the first and second containers and is defined by a substantially larger common design element surface area than any of the first, second third and fourth design element surface areas, wherein the first and second design elements and the third and fourth design elements are located entirely within the common design element surface area.

A second disclosure is directed to a dry offset metallic beverage container body decorating apparatus. The apparatus comprises a plurality of ink applicators. A plurality of printing plates each has a print surface in high relief which engages a corresponding ink applicator of the plurality of ink applicators and receives a quantity of fluid (typically ink) therefrom. A first image transfer blanket is rotationally mounted on the apparatus. The first image transfer blanket has a first ink receiving surface wherein the first ink receiving surface sequentially engages each print surface of the plurality of printing plates. A first unique design element is in high relief relative to directly adjacent portions of the first ink receiving surface bordering the first unique design element on the first ink receiving surface. A second unique design element is in low relief within the first ink receiving surface. A second image transfer blanket is also rotationally mounted on the apparatus. The second image transfer blanket has a second ink receiving surface wherein the second ink receiving surface also sequentially engages each print surface of the plurality of printing plates. A third unique design element is in high relief relative to directly adjacent portions of the second ink receiving surface bordering the third unique design element. The third unique design element is unique relative to the first design element on the first image transfer blanket. A fourth unique design element is in low relief within the second ink receiving surface.

This second disclosure may incorporate one or more the of the following elements, alone or in any reasonable combination. The apparatus may further comprise a beverage container indexer rotationally mounted to the apparatus having a plurality of stations each receiving a metallic beverage container body therein, the indexer rotationally delivering a plurality of metallic beverage container bodies sequentially and continuously to a printing site wherein a first metallic beverage container body rotationally engages the first image transfer blanket such that a first circumferential side wall of the first metallic beverage container body completes a full 360 degree rotation against the first ink receiving surface and receives ink therefrom at the printing site and wherein the indexer transfers the first metallic beverage container body from the printing site while simultaneously transferring a second metallic beverage container body to the printing site, wherein the second metallic beverage container engages the second image transfer blanket such that a second circumferential side wall of the second metallic beverage container body completes a full 360 degree rotation against the second ink receiving surface and receives ink therefrom. The first image transfer blanket and the second image transfer blanket further may further comprise an identical common design element received from the plurality of printing plates in combination. A distance between leading edges of the first design element and the third design element and trailing edges of the common design element on the first and second ink receiving surfaces, respectively, may be greater than or equal to a circumferential length of the first and second metallic beverage container bodies plus a length of an arc of the first and second metallic beverage container bodies subtending an angle of 20°. The first and second metallic beverage container bodies may be rotated against the first and second ink receiving surfaces, respectively, by at least 6.6 radians. The first, second, third, and fourth design elements may be defined by first, second, third, and fourth design element surface areas, respectively, and wherein the first and third unique design element surface areas may be less the second and fourth unique design element surface areas, respectively. The first, second, third, and fourth design elements may be defined by first, second, third, and fourth design element surface areas, respectively, and wherein the first and third unique design element surface areas may be substantially equal to the second and fourth unique design element surface areas, respectively. The first, second, third, and fourth design elements may be defined by first, second, third, and fourth design element surface areas, respectively, and wherein the first and third unique design element surface areas may be greater than the second and fourth unique design element surface areas, respectively. The first, second, third and fourth unique design elements may be alphanumeric characters. The first unique design element may be the same alphanumeric character as the second unique design element. The third unique design element may be the same alphanumeric character as the fourth unique design element. The apparatus may deliver a first overall decoration comprising the first and second unique design elements and the common design element from the first image transfer blanket to the first metallic beverage container body receives, and the apparatus may deliver a second overall decoration comprising the first and second unique design elements and the common design element from the second image transfer blanket to the second metallic beverage container body, wherein the first overall decoration is unique relative to the second overall decoration. A distance between a leading edge of the first design element and a leading edge of the second design element along a path parallel with a rotational movement of the first image transfer blanket may be within ±5% of a length of a circumference of a plurality of metallic beverage containers processed on the apparatus. A distance between a leading edge of the third design element and a leading edge of the fourth design element along a path parallel with a rotational movement of the second image transfer blanket may be within ±5% of a length of a circumference of a plurality of metallic beverage containers processed on the apparatus. The second and fourth design elements may each exhibit an absence of fluid received from the printing plates.

A third disclosure is directed to a method of decorating a plurality of substantially identical metallic beverage container bodies (i.e. within manufacturing tolerance of each other) using a dry offset decorating apparatus wherein each of the metallic beverage container bodies has an open end separated from a closed end by a circumferential side wall. The method comprising the steps of: (1) providing a first image transfer blanket comprising: a first ink receiving surface having a first unique design element in high relief relative to directly adjacent portions of the first ink receiving surface bordering the first unique design element and a second unique design element in low relief within the first ink receiving surface; (2) providing a second image transfer blanket comprising: a second ink receiving surface having a third unique design element in high relief relative to directly adjacent portions of the second ink receiving surface bordering the third unique design element and a fourth unique design element in low relief within the first ink receiving surface, wherein the third unique design element is unique relative to the first design element on the first image transfer blanket; (3) sequentially indexing each of the plurality of substantially identical metallic beverage container bodies to a printing site on the dry offset decorating apparatus; (4) engaging a circumferential side wall of a first metallic beverage container body with the first ink receiving surface of the first image transfer blanket and rotating the first metallic beverage container body circumferential side wall at least 6.6 radians while engaged with the first ink receiving surface and along a length of the first ink receiving surface greater than a circumferential length of the first metallic beverage container body circumferential side wall; and (5) engaging a circumferential side wall of a second metallic beverage container body with the second ink receiving surface of the second image transfer blanket and rotating the second metallic beverage container body circumferential side wall at least 6.6 radians while engaged with the second ink receiving surface and along a length of the second ink receiving surface greater than a circumferential length of the second metallic beverage container body circumferential side wall.

This third disclosure may include one or more of the following features, alone or in any reasonable combination. The first metallic beverage container body may have a resultant decoration that is unique relative to a resultant decoration exhibited by the second metallic beverage container body subsequent to the two engaging and rotating steps. The first unique design element may be spaced from the second design element on the first ink receiving surface such that rotation of the first metallic beverage container circumferential side wall by at least 6.2 radians against and along a length of the first ink receiving surface causes a first ink pattern associated with the first unique design element to be deposited on the first metallic beverage container side wall and causes a second ink pattern associated with the second unique design element to be deposited on the first metallic beverage container side wall and wherein the first ink pattern and the second ink pattern overlap. The third unique design element may be spaced from the fourth design element on the second ink receiving surface such that rotation of the second metallic beverage container circumferential side wall by at least 6.2 radians against and along a length of the second ink receiving surface causes a third ink pattern associated with the third unique design element to be deposited on the second metallic beverage container side wall and causes a fourth ink pattern associated with the fourth unique design element to be deposited on the second metallic beverage container side wall and the third ink pattern and the fourth ink pattern overlap. The first and second image transfer blankets may have an identical common design element on the first and second ink receiving surfaces, respectively, and which forms a boundary around the second and fourth unique design elements in low relief, respectively. The method may further comprise the steps of: (1) providing a plurality of ink applicators each supplied with a different color of ink; (2) providing a plurality of printing plates wherein each printing plate has a print surface in high relief; (3) engaging each of the plurality of ink applicators to a corresponding printing plate and transferring a quantity of ink thereto; (4) engaging each of the plurality of printing plates with first ink receiving surface to provide a common ink pattern associated with the identical common design element and to provide ink to the first unique design element in high relief prior to the engaging a circumferential side wall of a first metallic beverage container body with the first ink receiving surface of the first image transfer blanket step; (5) repeating the engaging each of the plurality of ink applicators to each of the plurality of printing plates step; and (6) engaging each of the plurality of printing plates with the second ink receiving surface to provide a common ink pattern associated with the identical common design element and to provide ink to the third unique design element in high relief prior to the engaging a circumferential side wall of a second metallic beverage container body with the second ink receiving surface of the second image transfer blanket step. The first and second image transfer blankets may have an identical common design element on the first and second ink receiving surfaces, respectively, and which forms a boundary around the second and fourth unique design elements in low relief, respectively. The first and third ink patterns may be defined by first and third ink pattern surface areas, respectively, and the second and fourth ink patterns may be defined by second and fourth ink pattern areas, respectively, wherein the first and third ink pattern surface areas are located completely within boundaries of the second and fourth ink pattern surface areas, respectively. The first and third ink patterns may be defined by first and third ink pattern surface areas, respectively, and the second and fourth ink patterns may be defined by second and fourth ink pattern areas, respectively, and wherein the first and third ink pattern surface areas are less the second and fourth ink pattern surface areas, respectively. The first and third ink patterns may be defined by first and third ink pattern surface areas, respectively, and the second and fourth ink patterns may be defined by second and fourth ink pattern areas, respectively, and wherein the first and third ink pattern surface areas are substantially equal to the second and fourth ink pattern surface areas, respectively. The first and third ink patterns may be defined by first and third ink pattern surface areas, respectively, and the second and fourth ink patterns may be defined by second and fourth ink pattern areas, respectively, and wherein the first and third ink pattern surface areas are greater than the second and fourth ink pattern surface areas, respectively. The first, second, third, and fourth unique design elements may be alphanumeric characters. The first unique design element may be the same alphanumeric character as the second unique design element. The third unique design element may be the same alphanumeric character as the fourth unique design element. The second and fourth design elements may each take a color of an uninked outer surface of the first and second metallic beverage container bodies.

A fourth disclosure is directed to a method of consecutively decorating a plurality of substantially identical metallic beverage container bodies using a dry offset decorating apparatus without manufacturing interruption wherein each of the metallic beverage container bodies has an open end separated from a closed end by a circumferential side wall by over-rotating first and second metallic beverage container bodies more than one complete revolution against first and second ink receiving surfaces on first and second image transfer blankets, respectively. A first metallic beverage container body first engages an ink-bearing leading edge of a first unique design element in high relief. A trailing edge of the first unique design element is separated from a leading edge of a common design element on the first ink receiving surface by a low relief portion of the first ink receiving surface. The first metallic beverage container body next engages an ink-bearing portion of the first ink receiving surfaces comprising the common design element thereon. A length of the common design element between the leading edge of the common design element and the trailing edge of the common design element is within ±5% of the length of the circumference of the first metallic beverage container body. A second unique design element on the first ink receiving surface is in low relief between the leading edge of the common design element and the trailing edge of the common design element.

The steps of this fourth disclosure may be repeated on a second metallic beverage in accordance with the disclosures set forth herein.

A fifth disclosure is directed to a method of consecutively decorating a plurality of substantially identical metallic beverage container bodies using a dry offset decorating apparatus without manufacturing interruption wherein each of the metallic beverage container bodies has an open end separated from a closed end by a circumferential side wall. The method comprising the steps of: (1) providing a first image transfer blanket comprising a first ink receiving surface having a first unique design element in high relief relative to directly adjacent portions of the first ink receiving surface bordering the first unique design element and a common design element in high relief on the first ink receiving surface, wherein a distance between a leading edge of the first unique design element and a trailing edge of the common design element is greater than a circumferential length of a circumferential side wall of the first metallic beverage container body plus a length of an arc of the circumference of the circumferential side wall of the first metallic beverage container body subtending an angle of 15°; (2) providing a second image transfer blanket comprising: a second ink receiving surface having a third unique design element in high relief relative to directly adjacent portions of the second ink receiving surface bordering the third unique design element and the common design element in high relief on the second ink receiving surface, wherein the third unique design element is unique relative to the first design element on the first image transfer blanket, and wherein a distance between a leading edge of the third unique design element and a trailing edge of the common design element is greater than a circumferential length of a circumferential side wall of the second metallic beverage container body plus a length of an arc of the circumference of the circumferential side wall of the second metallic beverage container body subtending an angle of 15°; (3) sequentially indexing each of the plurality of substantially identical metallic beverage container bodies to a printing site on the dry offset decorating apparatus; (4) engaging the circumferential side wall of a first metallic beverage container body with the first ink receiving surface of the first image transfer blanket and rotating the first metallic beverage container body circumferential side wall at least 6.5 radians from the leading edge of the first unique design element to the trailing edge of the common design element while engaged with the first ink receiving surface; and (5) engaging the circumferential side wall of a second metallic beverage container body with the second ink receiving surface of the second image transfer blanket and rotating the second metallic beverage container body circumferential side wall at least 6.5 radians from the leading edge of the second unique design element to the trailing edge of the common design element while engaged with the second ink receiving surface.

This disclosure may include one or more of the following features, alone or in any reasonable combination. The first metallic beverage container body may have a resultant decoration that is unique relative to a resultant decoration exhibited by the second metallic beverage container body subsequent to the two engaging and rotating steps. The rotating of the first and second metallic beverage container bodies for at least 6.5 rad may be carried out while the first and second metallic beverage container bodies are engaged with ink-bearing portions of the first and second ink receiving surfaces, respectively. The rotating of the first metallic beverage container body for at least 6.5 rad may cause a first ink pattern associated with the first unique design element to be deposited on the first metallic beverage container side wall and causes a common design ink pattern associated with the common design element to be deposited on the first metallic beverage container side wall and wherein an ink from the first ink pattern and an ink from the common design ink pattern directly overlap. The rotating of the second metallic beverage container body for at least 6.5 rad may cause a third ink pattern associated with the third unique design element to be deposited on the second metallic beverage container side wall and causes a common design ink pattern associated with the common design element to be deposited on the second metallic beverage container side wall and wherein an ink from the third ink pattern and an ink from the common design ink pattern directly overlap.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
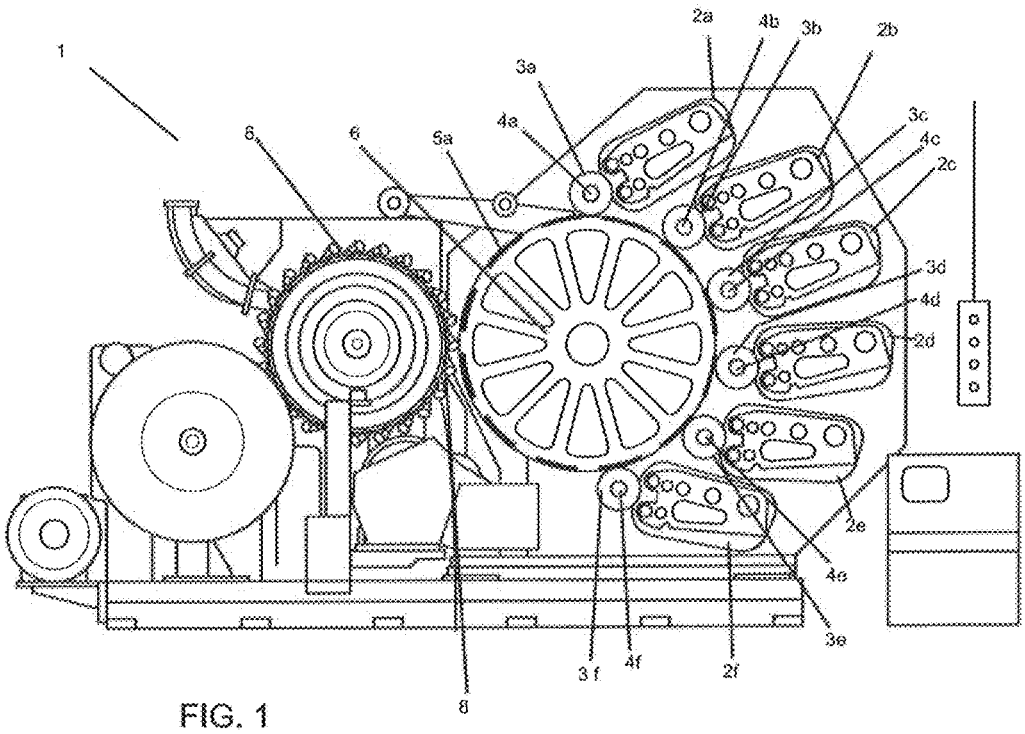
FIG. 1 is a view of the printing apparatus of the prior art.
Figure 2:
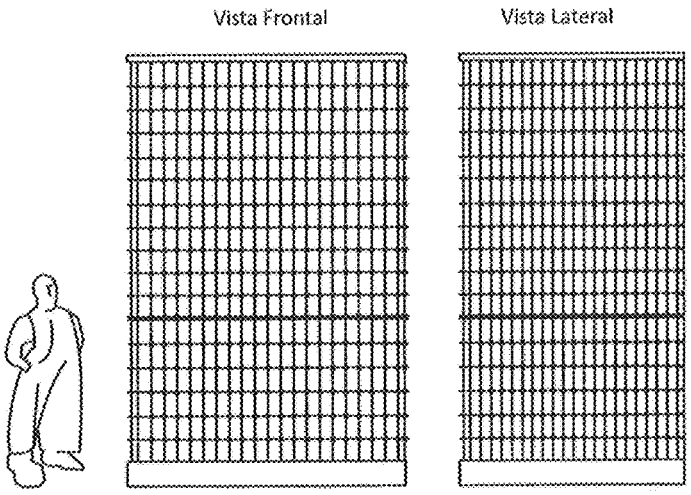
FIG. 2 is a schematic view of a pallet compared with a man of medium height.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The object of FIG. 1 was described above in the explanation of the prior art. However, it is important to stress that the invention in question is applied to a can printer, that is, a printing apparatus 1. The invention also relates to a modification introduced in such equipment, which enables one to print different finished arts onto cans, this printing takes place without interruption of the production.

Figure 3:
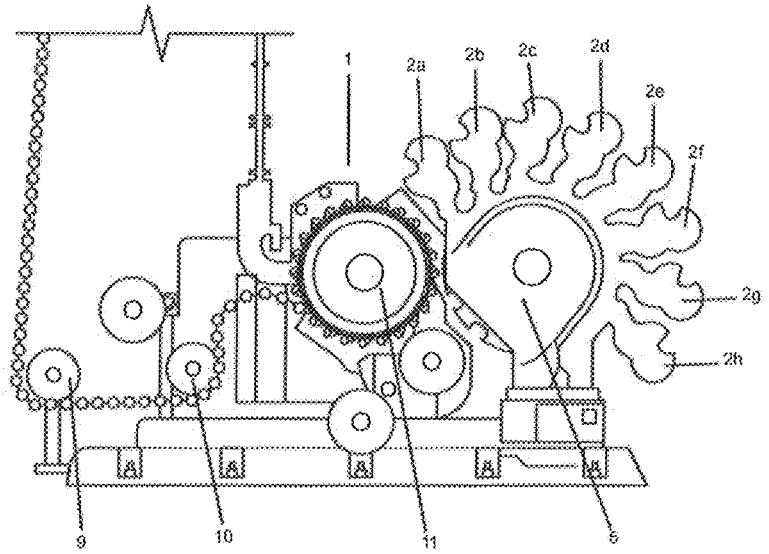
FIG. 3 is a perspective view of the printing apparatus of the present invention.

The printing apparatus 1 can be observed in greater detail in FIG. 3, which shows a can chain 7 having a plurality of cans 8 that are fixed to said can chain 7 in a rotatory manner. In the left portion of this FIG. 3, one can see cans 8 that come from the initial production processes, mainly from the mechanical shaping processes. These cans pass through a first directing wheel 9 and then through a second directing wheel 10. In this way, and with the aid of other elements of the equipment, not described or disclosed, it is possible to direct the cans 8 retained in the can chain 7 so that they will be led to the can carrying apparatus or can indexer 11.

On the can indexer 11, the cans are then displaced in a circle around said indexer 11. Although the cans 8 are retained in the can chain 7, they still have the possibility of turning around their main axis, i.e. a central longitudinal axis about which the can is formed.

In the right portion of FIG. 3, one can see eight ink-cartridges 2*a*-2*h*, positioned in half-moon arrangement, which follow the same central axle 12. It can be noted that, in this embodiment of the invention, there is a limited number of ink-holders, but it is important to point out that this is a project option, and there may be a larger or smaller number of ink-cartridges 2.

Figure 4:
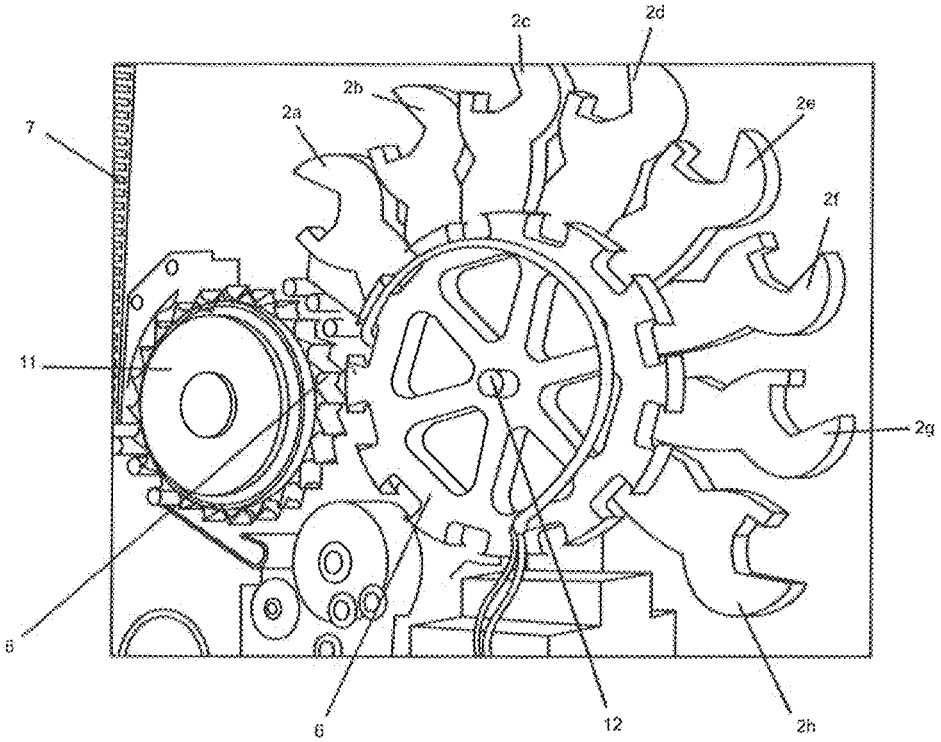
FIG. 4 is a perspective view of internal details of the printing apparatus of the present invention.

In FIG. 4, which shows the right portion of FIG. 3, one can see in greater detail the inside of the printing apparatus 1. The central axle 12 is, indeed, the transfer blanket drum 6, which has a radial arrangement of the ink-cartridges 2*a*-2*h* close to part of its perimeter.

However, the ink-cartridges 2*a*-2*h* do not rest on the transfer blanket drum 6, since between each ink cartridge 2*a*-2*h* and the transfer blanket drum 6 there are respective plate cylinders 4*a*-4*h*. As mentioned above, on the plate cylinders 4*a*-4*h* there are respective printing plates 3*a*-3*h* that have the finished arts in relief on their outer surface facing the transfer blanket drum 6.

Moreover, the printing plates 3*a*-3*h* are responsible for the communication between the ink-cartridges 2*a*-2*h* and the transfer blankets 5*a*-5*l*, which are placed on the outer surface of the transfer blanket drum 6. Obviously, there should be a positioning/interaction between the printing plates 3*a*-3*h* and the transfer blankets 5*a*-5*l*, so that the transfer blankets 5*a*-5*l* can interact in a precise manner with the cans 8 to be printed.

Figure 5:
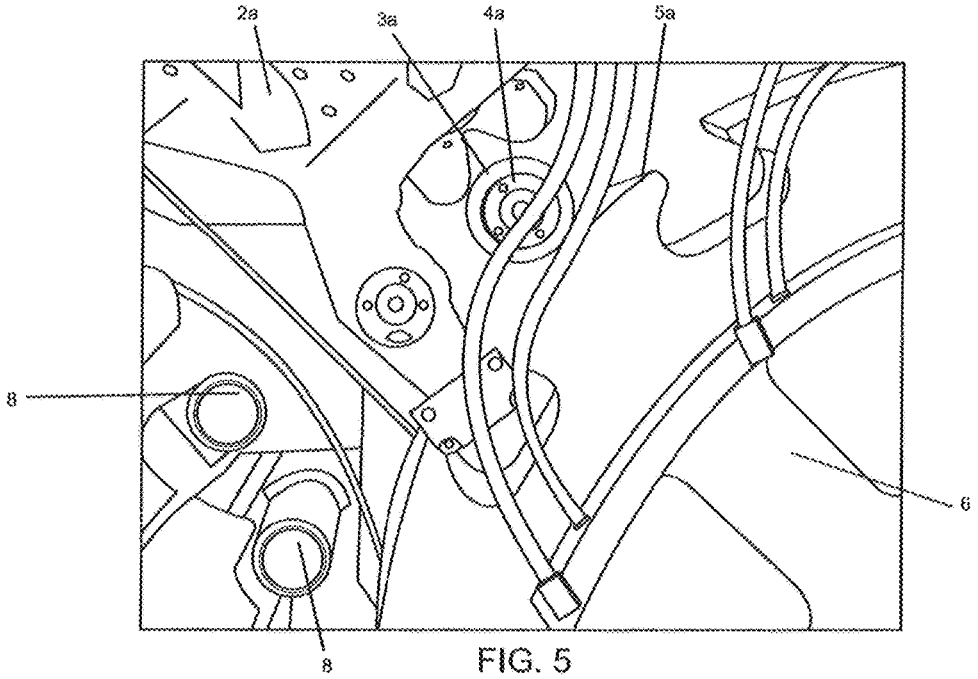
FIG. 5 is an enlarged perspective view of internal details of the printing apparatus of the present invention.

With a view to exemplify how the interaction between the components responsible for the printing takes place, FIG. 5 shows an internal portion of the printing apparatus 1. For practical purposes, one will demonstrate only the functioning of a part of the transfer of ink for printing, since the process is analogous for each ink-cartridge.

Figure 6:
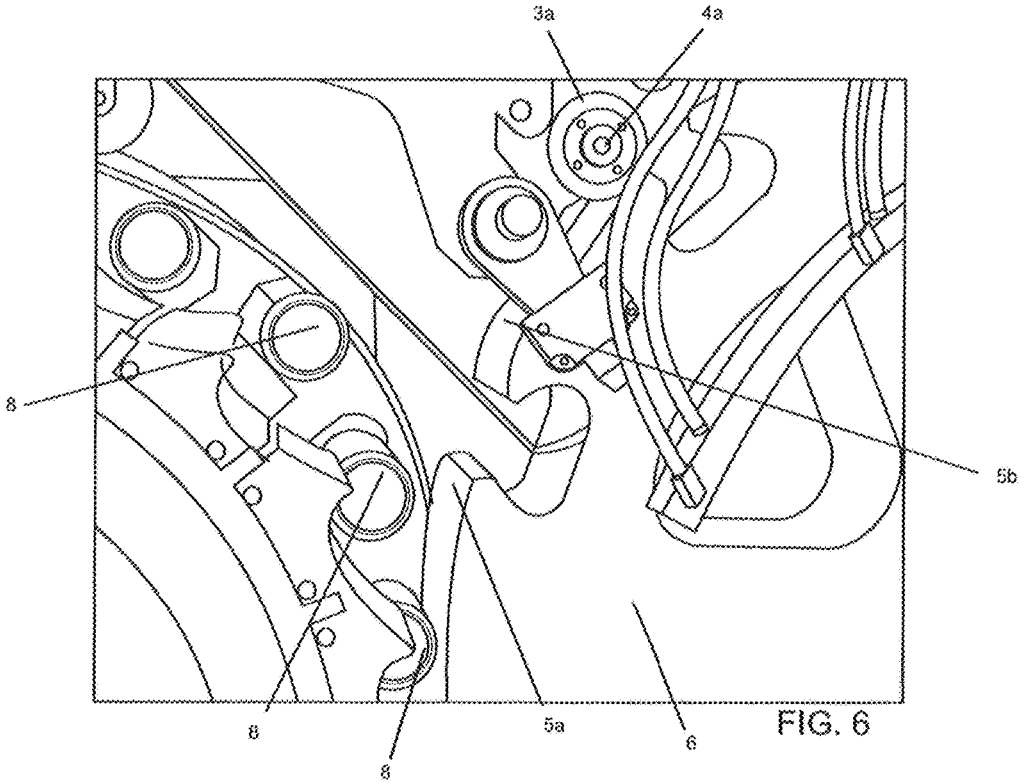
FIG. 6 is an enlarged perspective view of internal details of the printing apparatus of the present invention.

In FIGS. 5 and 6, the process, also an object of the present application, can be better understood, wherein the ink cartridge 2*a* supplies ink to the printing plate 3*a* present on the plate cylinder 4*a*, and ink is transferred chiefly to the high reliefs existing there, which have a finished art or print arrangement.

The plate cylinder 4*a*, upon coming into synchronized contact by the printing plate 3*a* with the transfer blankets drum 6, supplies ink from its high relief to the transfer blanket 5*a*, wherein this takes place by rotation of the printing plate that transfers the ink present on high relief to the transfer blanket 5*a*.

Afterwards and by opposite directions rotation of the transfer blanket drum 6 and the can indexer 11, the transfer blanket 5*a* that has the ink from the printing plate 3*a* transfers the ink present on the transfer blanket 5*a* to the can 8, which is rotated under some pressure against the transfer blanket 5*a*.

It is pointed out that, if it is necessary to print more than one finished art or different colors onto the can 8, the transfer blanket 5*a* will also have passed through the other printing plates 3*b*-3*h* present on the respective plate cylinders 4*b*-4*h*. The same occurs successively with the other transfer blankets 5*b*-5*l* that have the finished art coming from any printing plates that are necessary for obtaining all the finished art of different colors on the cans 8 to be printed.

Thus, the finished arts present on the printing plates are transferred to the transfer blankets, which in turn transfer ink to the cans 8.

Figure 7:
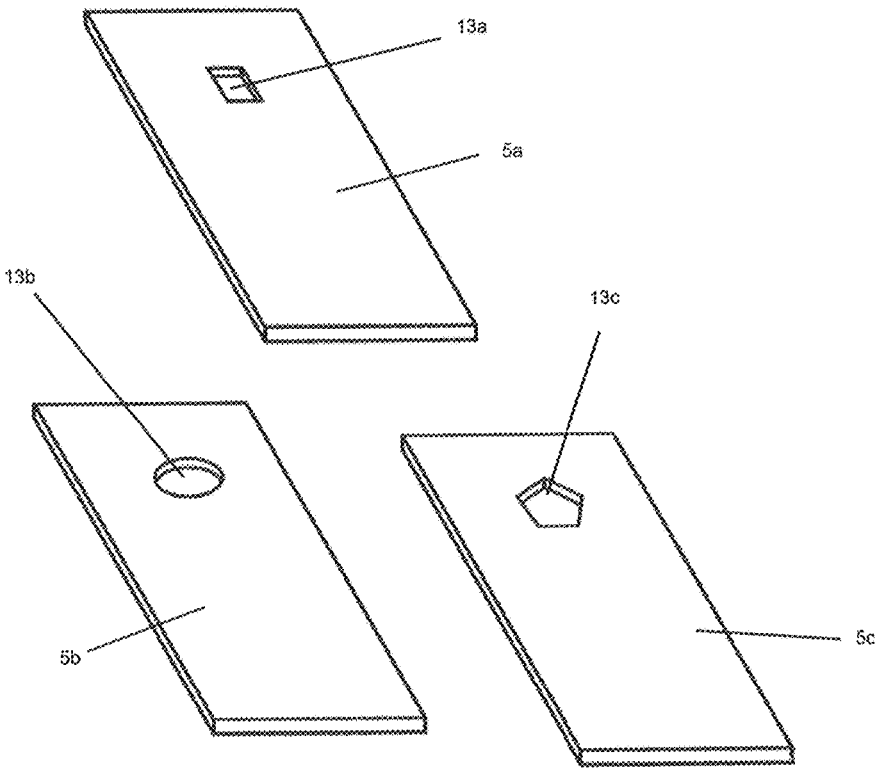
FIG. 7 is a perspective view of a set of transfer blankets.

The transfer blankets of the present invention can be seen in FIG. 7.

Usually, that is, in the prior art, these transfer blankets are only smooth surfaces that are used as ink transferring means between the printing plates 3*a*-3*h* and the cans 8 to be printed. However, in the present invention the transfer blankets also have the function of being a graphics mean that has influence on the finished arts of the cans 8 to be printed.

In the example of FIG. 7, one demonstrates only three transfer blankets 5*a*-5*c*, but there may be several blankets with low relief according to the need for different finished arts on the cans 8. In other words, the number of different finished art or graphs from the blankets on the cans is limited to the number of blankets present on the blanket drum 6.

In the preferred embodiment of the present invention one has opted for using a transfer blanket drum with twelve blankets 5*a*-5*l*, but, as mentioned before, only three blankets are shown in FIG. 7.

It is of the utmost importance to note that the transfer blankets 5*a*-5*c* have respective low reliefs 13*a*-13*c*, wherein the low reliefs of finished arts are in reality low relief 13*a*-13*c* with different shapes. Therefore, there is a finished art in low relief 13*a* present on the blanket 5*a*, a finished art in low relief 13*b* present on the blanket 5*b* and another finished art in low relief 13*c* present on the blanket 5*c*.

Thus, when there are three types of blankets 5*a*-5*c* with different finished arts in low relief, it is possible that all the finished arts coming from printing plates will be transferred by ink to the transfer blankets 5*a*-5*c*, so that the cans 6 will be printed in this way.

However, since each of the finished arts 13*a*-13*c* is in low relief, there will be no ink in this low-relief portion of each of the blankets. There will be no contact, in this low-relief region, between the blanket and the cans 8 to be printed. Indeed, the original color of the can 8 will remain in this region free from ink or free from contact between the can 8 and the respective blanket that is transferring the ink from the transferring blankets to the can 8.

Figure 8:
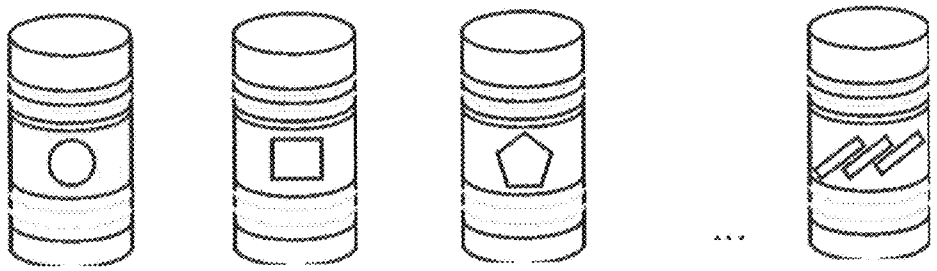
FIG. 8 is a perspective view of a set of printed cans according to the present invention.
Figure 9:
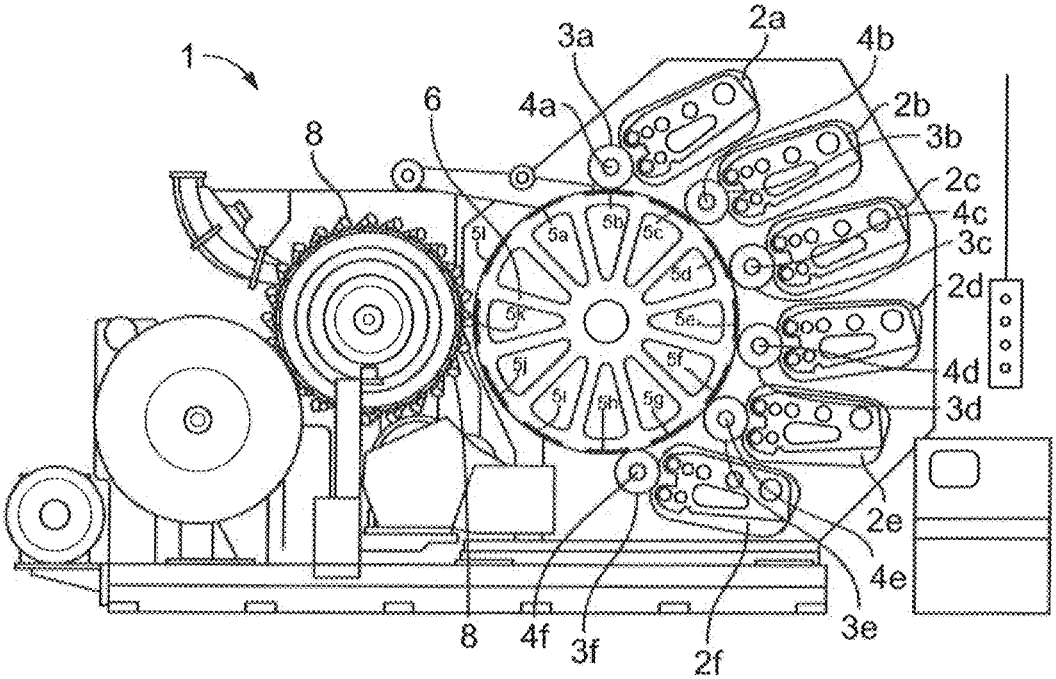
FIGS. 9-16 are alternate versions of FIGS. 1-8, respectively.
Figure 10:
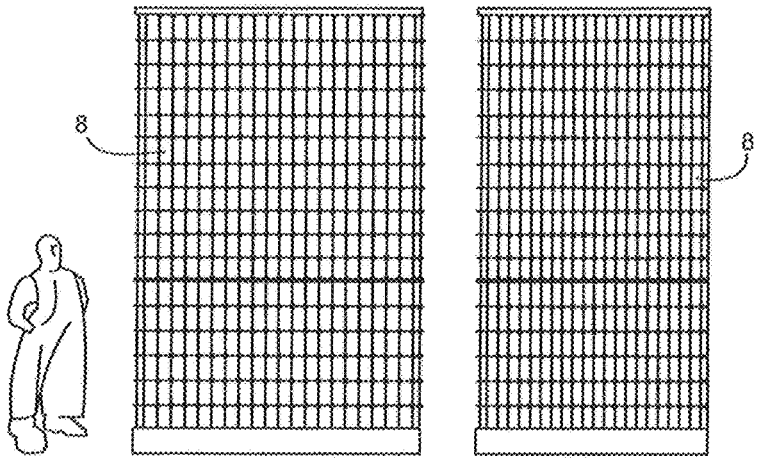
Figure 11:
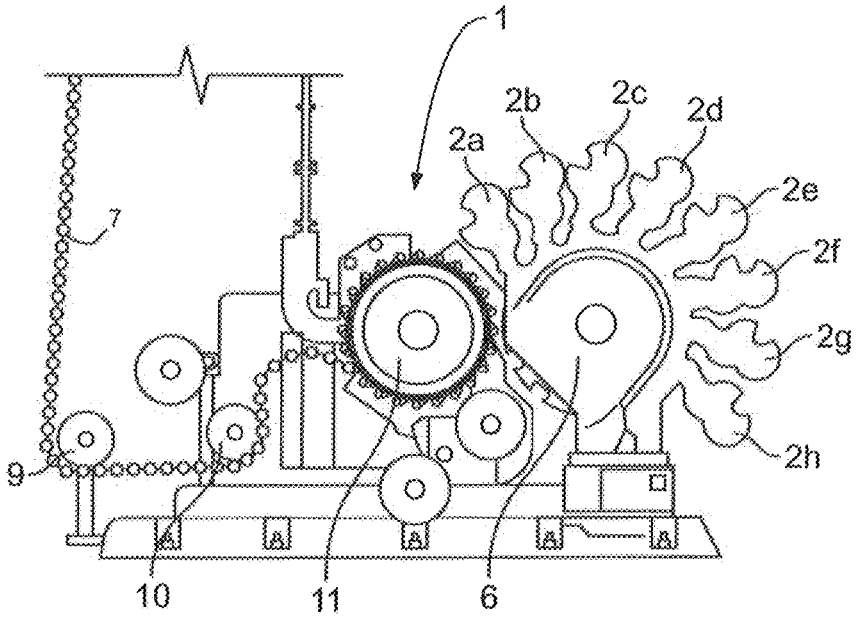
Figure 12:
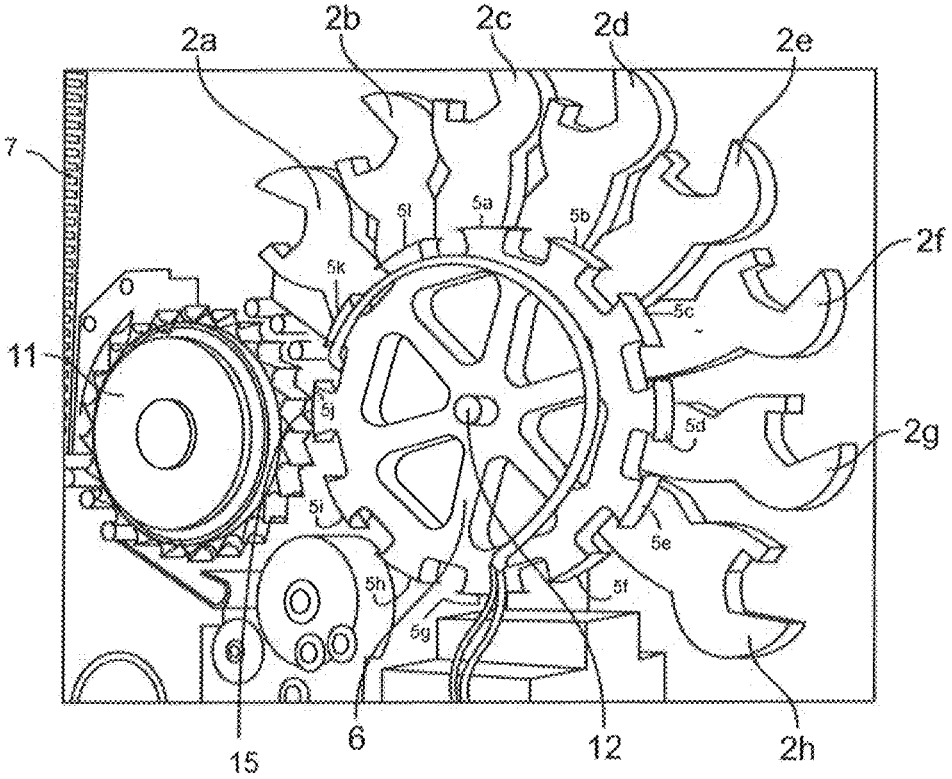
Figure 13:
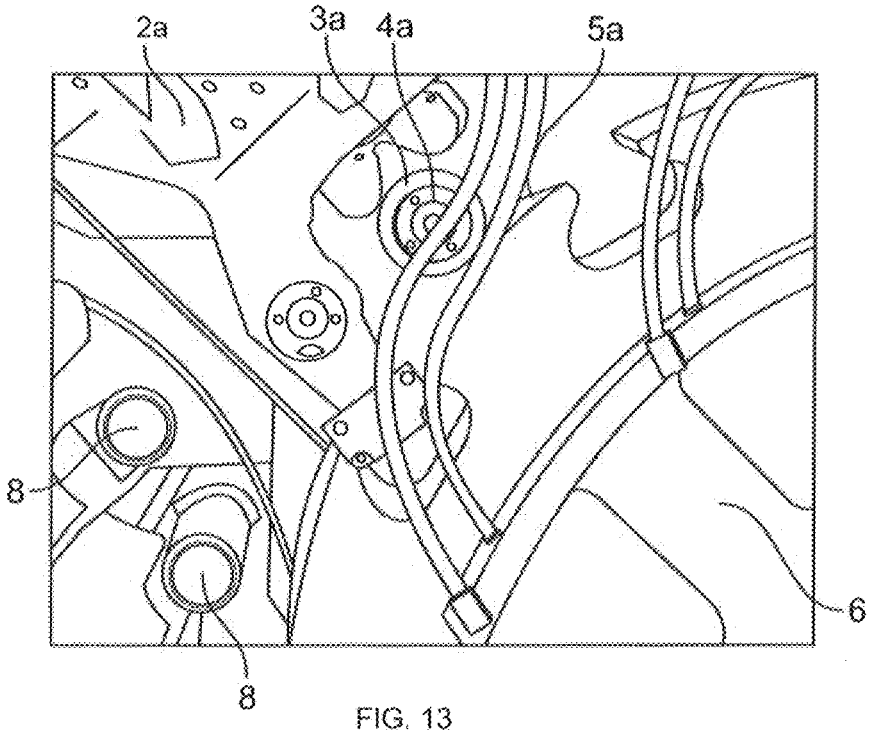
Figure 14:
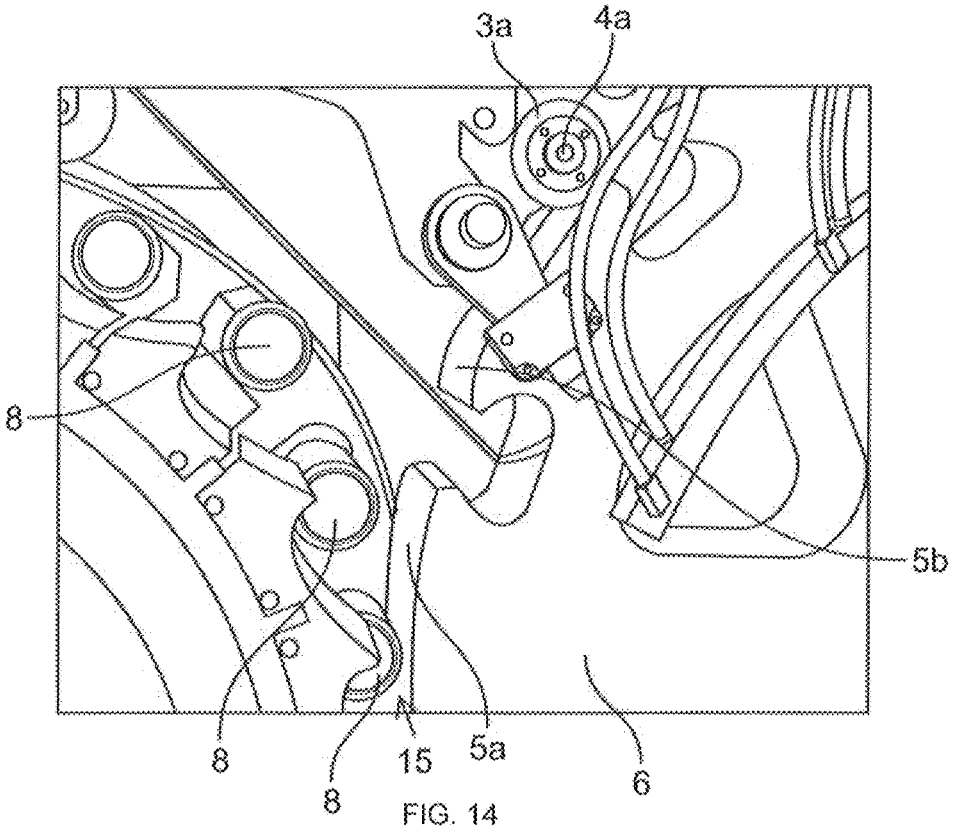
Figure 15:
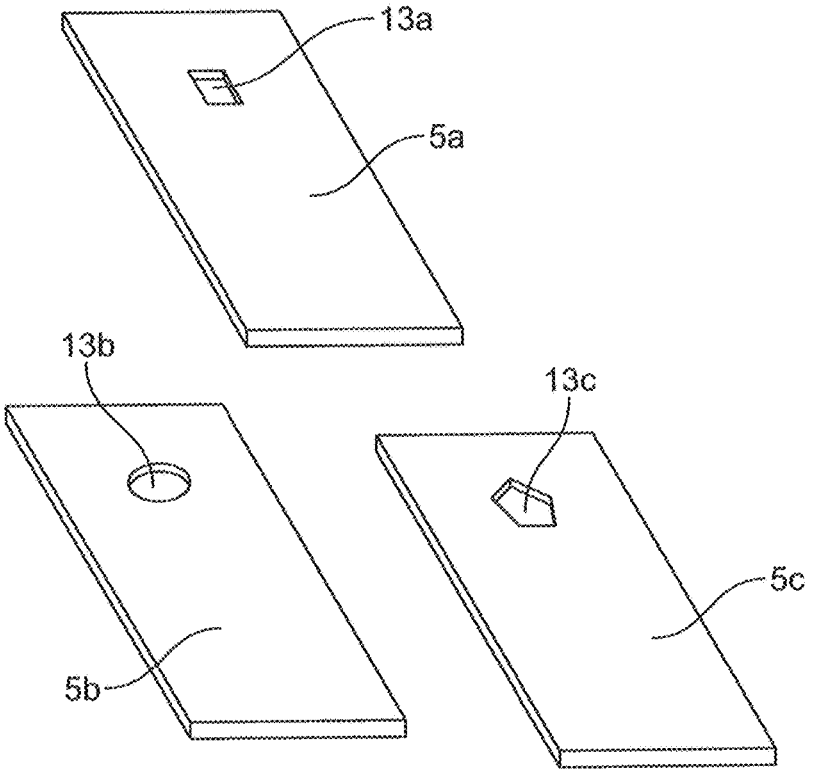
Figure 16:
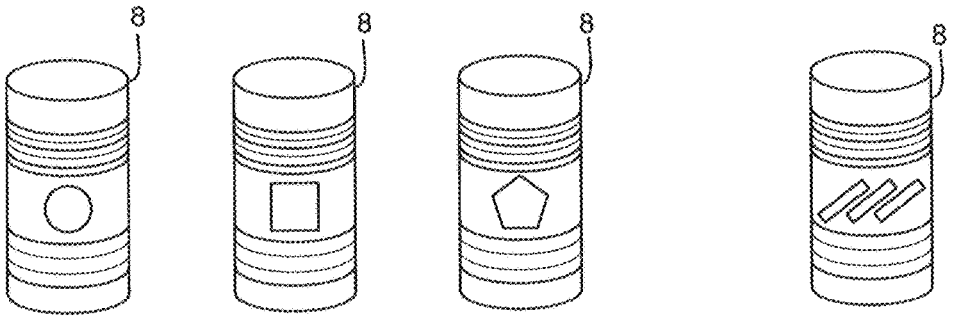

Therefore, if there is a low-relief finished art 13*a* on the blanket 5*a* which, in the present example, a circle, there will be no print or ink transfer from this low-relief region to the can 8. Therefore, a first finished art is formed on the can 8, as shown in FIG. 8, which is in the form of a circle, for explanation purposes.

Thus, the next can 8 to be printed will also receive ink from the printing plates, but from the next blanket. In this example, the transfer blanket 5*a* has a low-relief finished art 13*b* in the form of a rectangle. In this way, the can to be printed will have a second finished art in the form of a rectangle in the original color of the can.

Following the same logic, a third can to be printed will also receive ink from the printing plates, but from a subsequent blanket other than the first two ones. This third transfer blanket 5*c* has a low-relief finished art 13*c* in the form of a pentagon, so that the can to be printed will have a third finished art in the form of a pentagon in the original color of the can.

As already mentioned, the number of different finished art on the cans will only be limited to the number of blankets present on the blanket drum 6.

It is further stressed that the finished arts present on the blankets—that are portions of removed material of the blankets—are arranged directly on the blankets without any other type of layer on the blanket, so that the latter can have the printing function, i.e., the function of having a finished art that will be present on the printed can.

It is reiterated that the low reliefs or portions of material removal will represent absence of ink, which will enable one to view the original color of the can, be it the color of the aluminum or of a coating of other coloring that the can to be printed already has.

The finished art produced by the low relief will be a final contour on the printed can, which will provide a clearer finished art, and the low relief present on the blanket will have less problems with usual printing aspects, such as, for instance, ink stains, smears or any other type of problem related to the high-precision printing or detailing.

In FIG. 8, one demonstrates by reticence that there is the possibility of more than three types of finished arts from the printing process and apparatus of the present invention. This is verified through a subsequent can with another finished art in the form of three consecutive lines.

Obviously, the finished arts or graphic arrangements are not limited to geometric shapes, but may be any type of graphic means that one desires to print on the cans 8, as for example, names of persons, of teams, figures, etc. In this regard, the limitation is no longer in the printing process, but rather in the creativity of those who develop the finished arts to be applied to the printed cans.

In the face of the foregoing, it is possible to have, in the same uninterrupted production line, cans with different finished arts, which was possible only with the interruption of the production line until the advent of the present invention.

However, it was not feasible, in terms of logistics, to obtain cans from the same production sequence with different finished arts on the same pallet, or still delivered to the beverage manufacturers, such as supermarkets. However, this has become possible with the present invention.

According to another embodiment of the present invention, artwork with improved resolution and/or increasing complexity can be generated using transfer blankets 5*a*-5*l* with improved, highly detailed low-relief features. In the prior art, the printing plates 3*a*-3*h* carry detailed art in high relief as described above. The high relief art is transferred to a transfer blanket 5*a*-5*l* which then prints the can 8. As described above, the transfer blankets 5*a*-5*l* may be supplied with low relief art wherein the can 8 will have an area devoid of ink corresponding to the low relief art on the transfer blankets 5*a*-5*l*. By way of example, under a prior art printing process, printing plate 3*a*-3*h* will have a relief feature. To print, for example, "BRAND X SODA" on a can, a printing plate 3*a*-3*h* has "BRAND X SODA" in high relief a surface of the printing plate 3*a*-3*h*. Then the ink is applied to the high relief on the surface of the printing plate in the shape of "BRAND X SODA".

In the present invention, it is contemplated that improved and more flexible high resolution low-relief features can be generated by treating the transfer blankets 5*a*-5*l* with a suitable laser beam. In this embodiment, portions of the blanket 5*a*-5*l* are removed by laser treatment. Through laser ablation, very different, highly complex and detailed relief patterns can be created on each of the transfer blankets 5*a*-5*l*, rather than simple shapes and the like as discussed above.

For example, each blanket 5*a*-5*l* is typically produced from a non-metallic material such as a rubber (or a polymer or composite) rectangle the size of a legal paper. Each blanket is typically ⅛ to ¼ inch thick (3.2 mm to 6.4 mm). Shading can be generated by varying the depth and size of the low-relief features. In practice, printed areas on a finished can be made lighter or darker depending on how much of the surface of a particular transfer blanket 5*a*-5*l* is removed during the laser treatment process.

Basically, there are two different properties that are essential to the laser treatment discussed herein: tolerance of the cut and surface finish. Standard technology laser cutting equipment that has been in use for 5+ years uses a focused laser beam. The spot size of the laser beam determines the tolerance and the surface finish. Older laser cutting machines that have been in service for 5+ years, have 0.008 to 0.010 inches spot diameter size (0.2 mm to 0.3 mm). Newer laser cutting machines a focus within a spot diameter size of 1-2 thousandths (0.001 to 0.002 inches) of an inch (0.03 mm to 0.05 mm). Generally, using a laser as contemplated by the inventors, a low-relief feature having a surface finish or depth as little as 0.001 inches (0.03 mm) or less can be created.

In creating high resolution low-relief features on a transfer blanket 5*a*-5*l* using a laser cutting apparatus, the apparatus must position and move the beam accurately. Because the beam is moving in two dimensions (e.g., an X & Y coordinate system) speed of the laser beam movement must be controlled. For example, if a straight cut is being generated, the laser beam speed across the surface of the transfer blanket needs to be constant. Once a curved cut or low-relief pattern is desired, the speed at which the laser beam travels must be varied so that the laser beam can affect the cut itself. Software and algorithms calculate the proper speed of the laser beam along the surface as cuts are made. Suitable transfer blankets have been manufactured using a 420 W Stork® brand laser engraver set at a speed of about 12 m/s The result is a smooth cut and a smooth surface finish.

To avoid a resultant blurring effect on a finished can caused by the low-relief features produced by laser ablation on the transfer blankets 5*a*-5*l*, the surface of the transfer blanket 5*a*-5*l* must have a better surface finish, especially, or primarily, an edge of the transfer blanket surface between the low-relief laser ablated surface and an untreated surface. The better the edge surface the laser creates, the better the printed edge of the finished product. This better surface finish will result in a cleaner, crisper image.

Final surface finish of a laser treated transfer blanket 5*a*-5*l* is dependent on the transfer blanket 5*a*-5*l* thickness prior to laser treatment. A thicker transfer blanket will have a rougher final surface finish. The laser does not cut as smoothly in thicker substrates.

However, depending on the algorithm, the speed, and the arc, smoothness of the laser cut can be improved. When a laser is cutting an arc or intricate shapes, the algorithm will change the speed and how the laser beam is moving. This results in a cleaner shape.

In generating transfer blankets of the present invention laser beam spot size was generally on the order of 0.003 inches (0.08 mm). However, such a spot size is inadequate for producing cans with high resolution graphics devoid of ink as contemplated herein. More specifically, the inventors determined that transfer blanket low-relief pattern quality suffers when a laser beam spot size greater than 0.002 inches (0.05 mm) is employed. This will result in a target surface finish of about 125 to 250 micro inches (about 0.002 inches or 0.05 mm).

Figure 17:
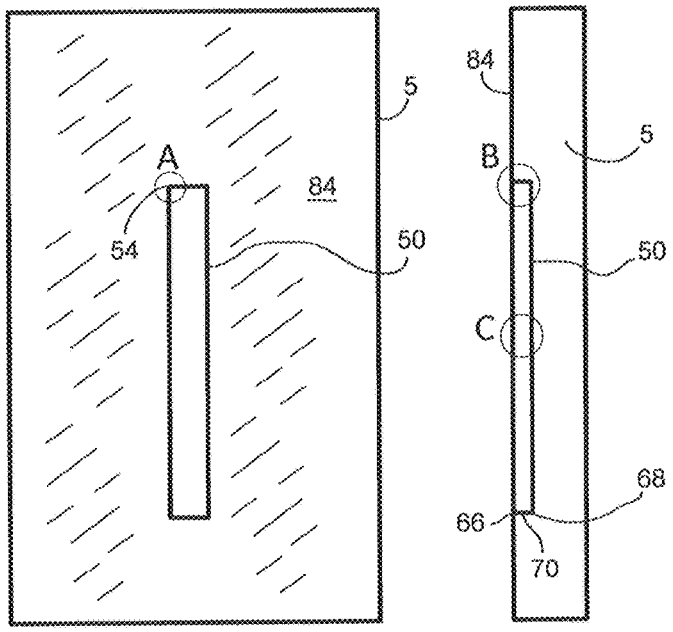
FIG. 17 is a top and cross-sectional view of a transfer blanket showing zones A, B, and C.

To illustrate this aspect of the invention, referring to FIGS. 17-23, a transfer blanket 5 is treated with a laser to produce a low-relief rectangle 50. A zone A of FIG. 17 represents a corner 54 of the rectangle on an upper surface of the blanket 5 forming an edge between a laser treated portion of the blanket 5 and an untreated portion of the blanket 5; a zone B represents inside corners 66,68 of the rectangle 50; and a zone C represents a laser treated surface finish upon the rectangle floor.

Figure 18:
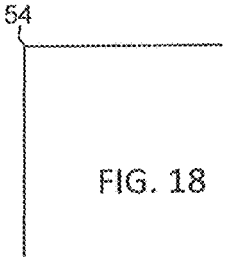
FIG. 18 is a magnified view of zone A from FIG. 17.
Figure 19:
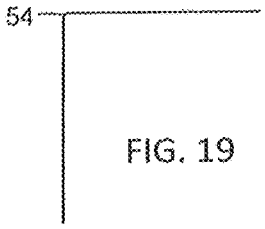
FIG. 19 is a magnified view of zone A from FIG. 17.
Figure 20:
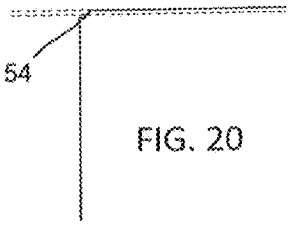
FIG. 20 is a magnified view of zone A from FIG. 17.

Referring to FIGS. 18-20, in zone A, the corner 54 quality is a function the laser beam design, accuracy of the XY coordinate axis positioning, and the blanket 5 material. As shown in FIG. 18, a sharp 90° corner is difficult to achieve. Generally, the corner exhibits a certain radius of curvature as shown in FIG. 19. Regarding the edge level quality in FIG. 19, the edge quality of the corner 54 is material dependent because projection of the blanket material may take place during laser treatment. Thus, the contour of the cut must be within 2 parallel lines as shown in FIG. 20.

Figure 21:
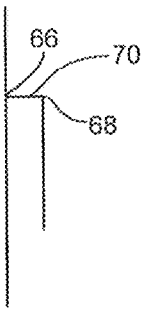
FIG. 21 is a magnified view of zone B from FIG. 17.
Figure 22:
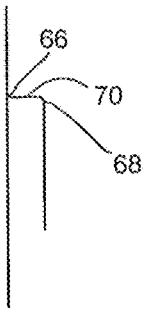
FIG. 22 is a magnified view of zone B from FIG. 17.
Figure 23:
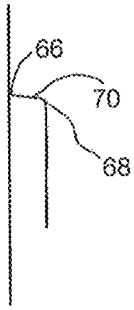
FIG. 23 is a magnified view of zone B from FIG. 17.

Referring to FIG. 21, in theory, in zone B, sharp angles at the inside corners 66,68 would result from laser ablation forming the rectangle 50. However, as shown in FIG. 22, due to the laser milling process, there will be 2 separate curvatures at the corners 66,68, a first radius of curvature on the edge of the corner 66 forming the contour of the rectangle and a second radius of curvature at the corner 68 forming a bottom of the ablated groove. These radii are specific to the laser process used (laser type, laser parameters, material type). As shown in FIG. 23, a wall 70 between the corners 66,68 is angled between 75° and 105°, typically angled outwardly greater than 90°, more specifically 105°±5°. In practice, substantially 90° angles are formed at the corners when forming a solid image, such as the rectangle 50 shown. When producing micro portions or dots as described below, the wall 70 will generally be angled according to the parameters set forth above.

Further, the corner 66 forming the contour of the rectangle is critical in establishing the high level of graphic quality discussed hereinafter. A surface finish of the transition between an upper surface of a blanket 5 on which ink is deposited by a printing plate 3 (high relief portion) and the recessed portion of the blanket 5 (low relief portion) is less than or equal to 3.5 $R_a$, preferably less than 3.5 $R_a$, and more preferably 3.0 $R_a$±0.1 $R_a$. Additionally, the most preferable surface finish in this region has 3.33 $R_{max}$. Adequate blankets have been manufactured having a surface finish of about 3.03 $R_a$.

In zone C, the rectangle floor's surface finish is a function of laser technology and blanket material. A target of 125 to 250 micro inches (about 0.002 inches or 0.05 mm) for the surface finish is preferred to achieve desired results. Suitable blankets having a surface roughness of 3.03 $R_a$ (3.33 $R_{max}$) have been produced having a floor depth of about 0.015 inches (0.38 mm). It has been determined that the floor depth of about 0.015 inches (0.38 mm) performs well in that ink is not transferred from the low relief floor to the beverage container 8 when the floor is at least 0.015 inches (0.38 mm).

Figure 24:
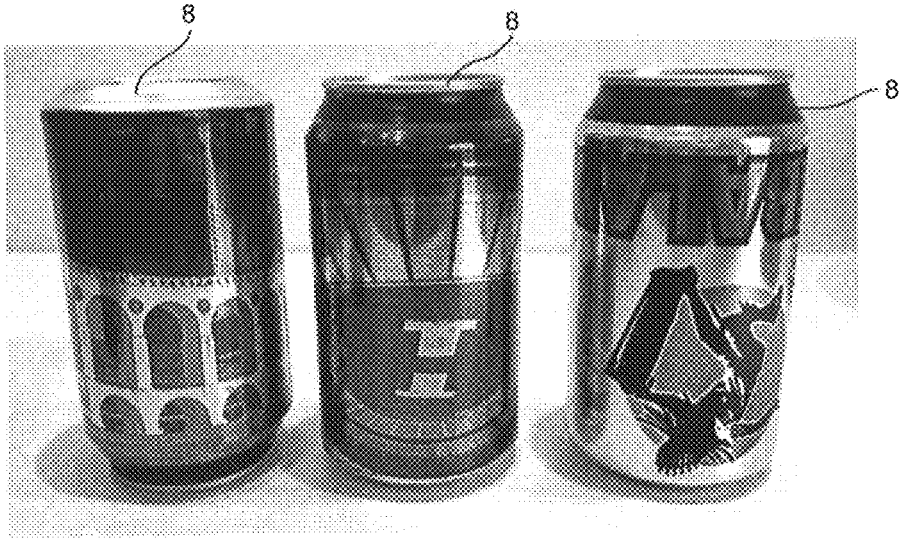
FIG. 24 is a photograph of three sequentially produced cans according to the principles of the present invention.
Figure 25A:
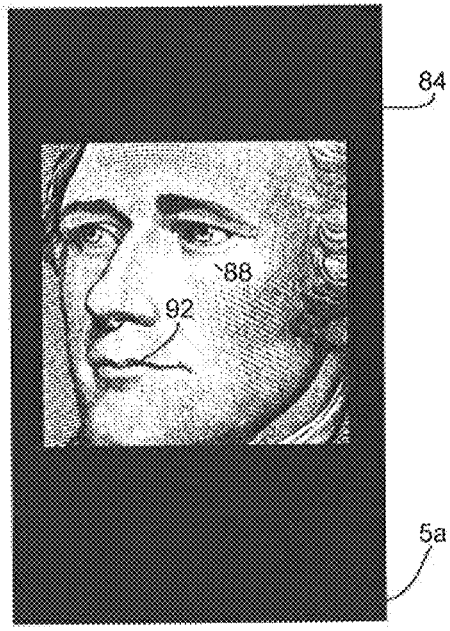
FIGS. 25A-D are front views of blankets of the present invention.
Figure 25B:
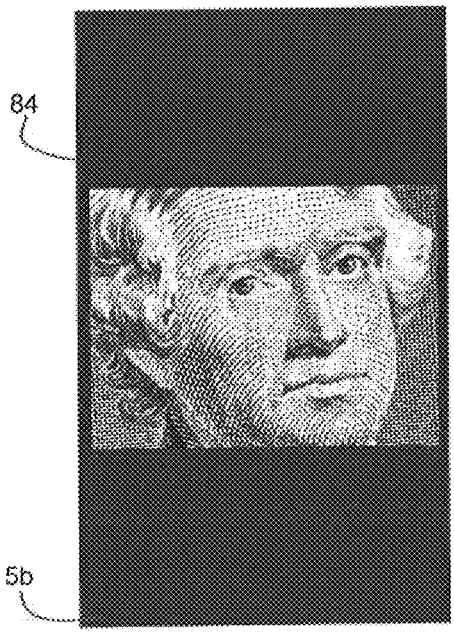
Figure 25C:
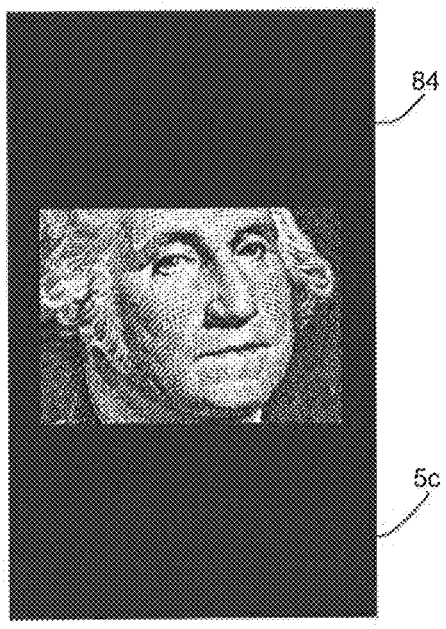
Figure 25D:
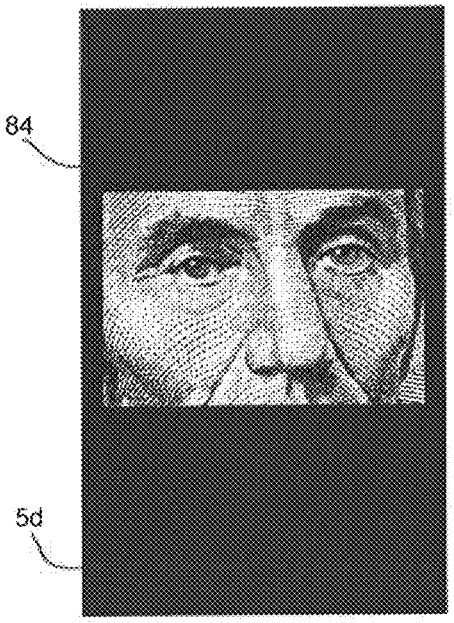
Figure 26:
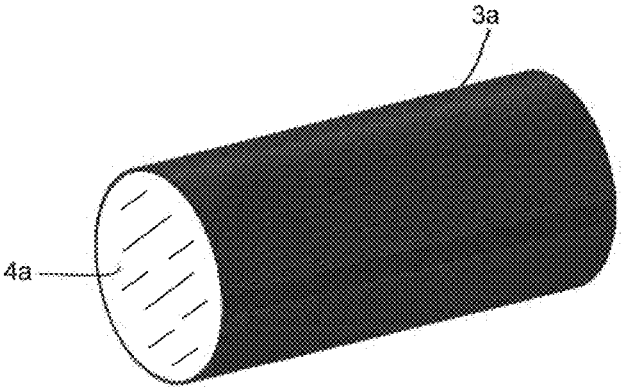
FIG. 26 is a perspective view of an inked printing plate affixed to a plate cylinder wherein substantially an entirety of the inked surface of the printing plate is in high relief.
Figure 27A:
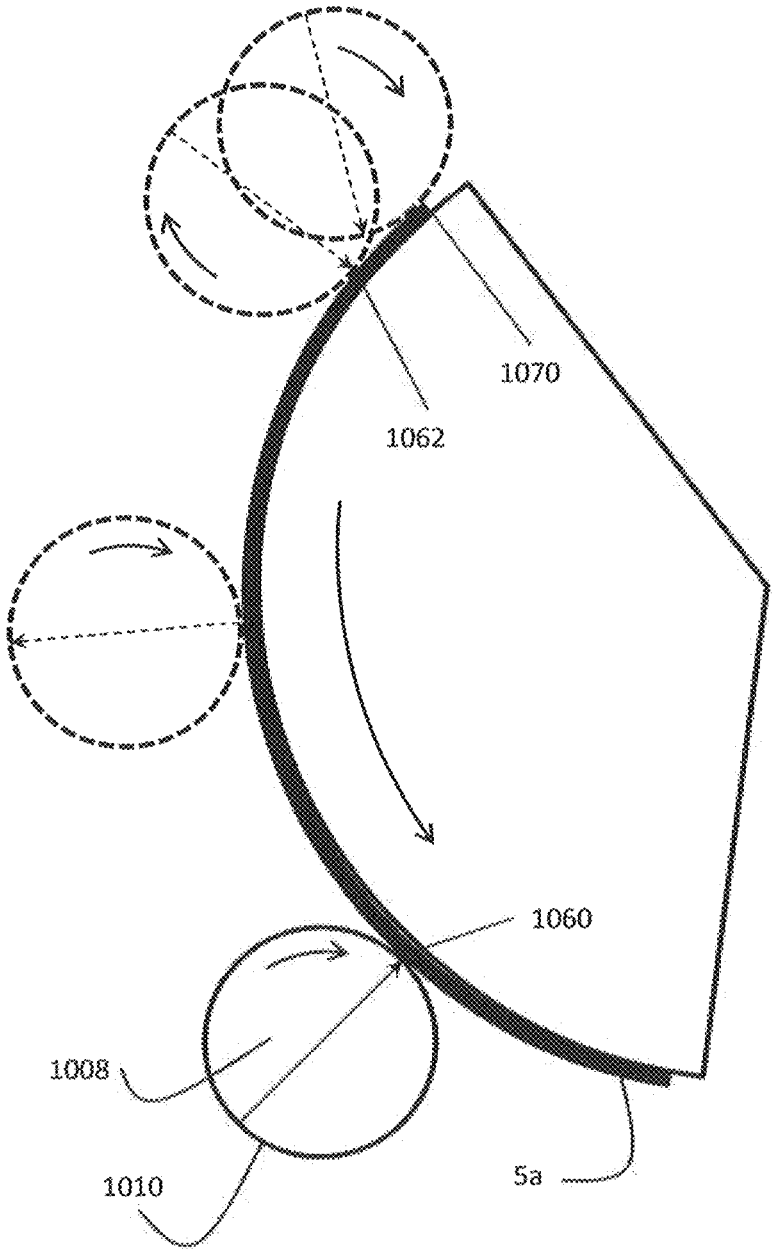
FIG. 27A is a side view of a metallic beverage container body rotating and traversing an image transfer blanket.
Figure 27B:
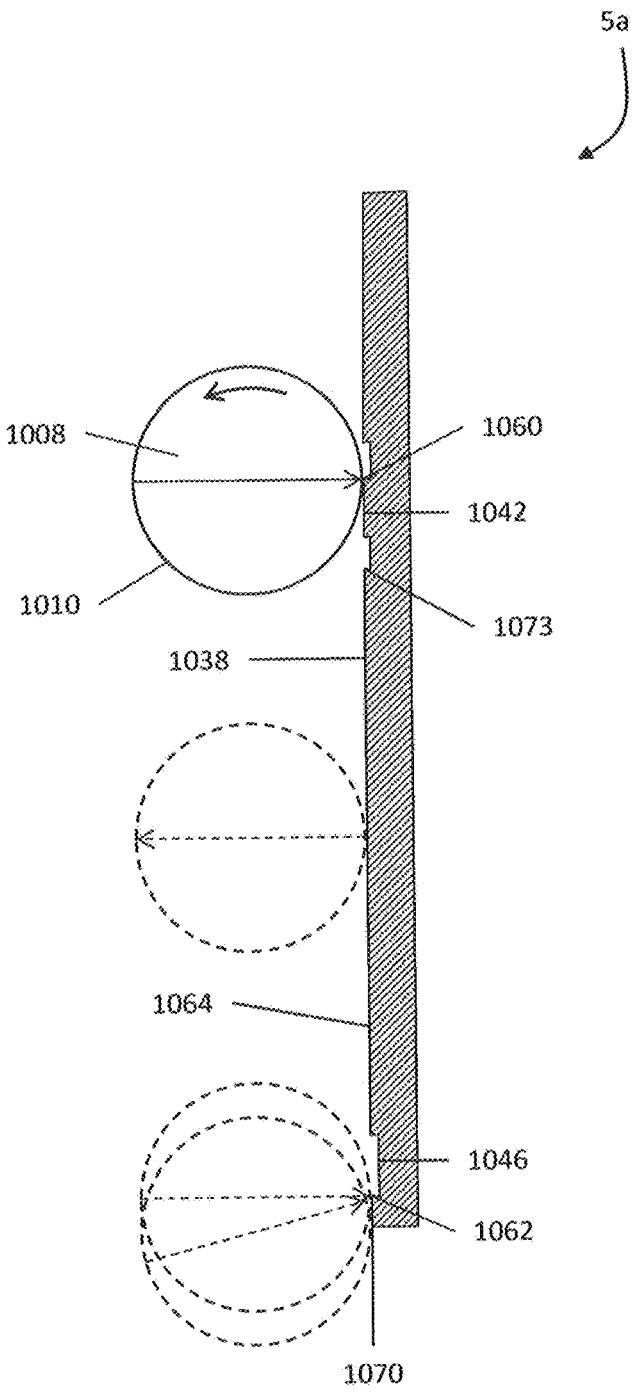
FIG. 27B is an alternative side view of a metallic beverage container body rotating and traversing an image transfer blanket with an over-rotation of about 15°.
Figure 28:
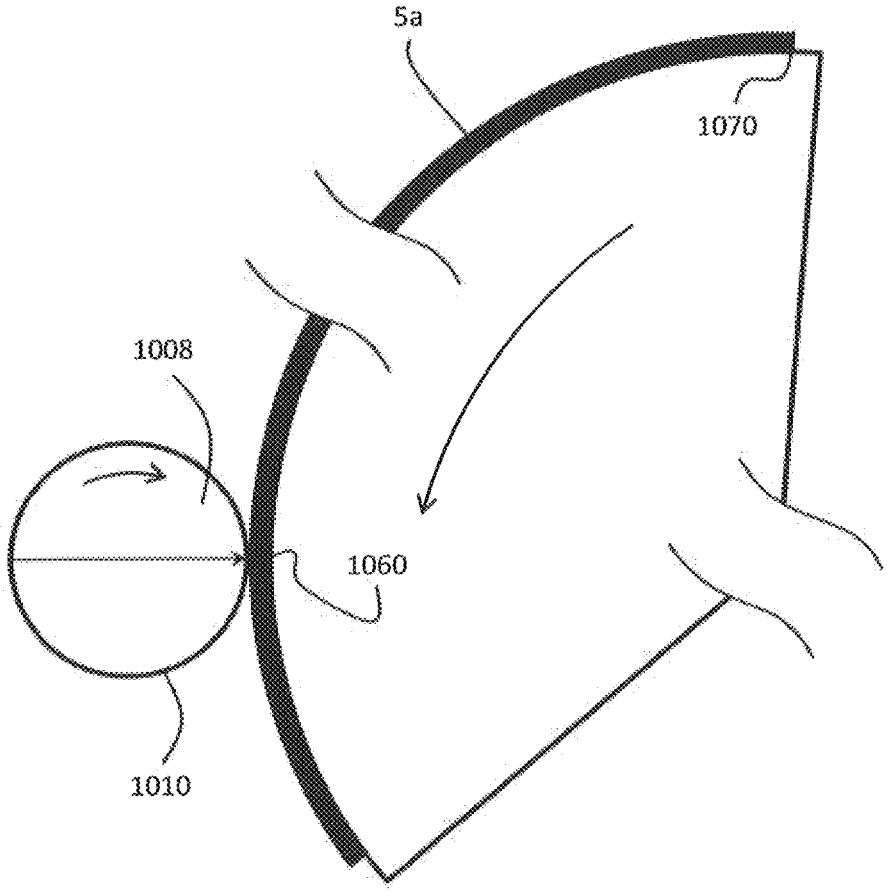
FIGS. 28-30 are side views illustrating a metallic beverage container body rotating and traversing an image transfer blanket.
Figure 29:
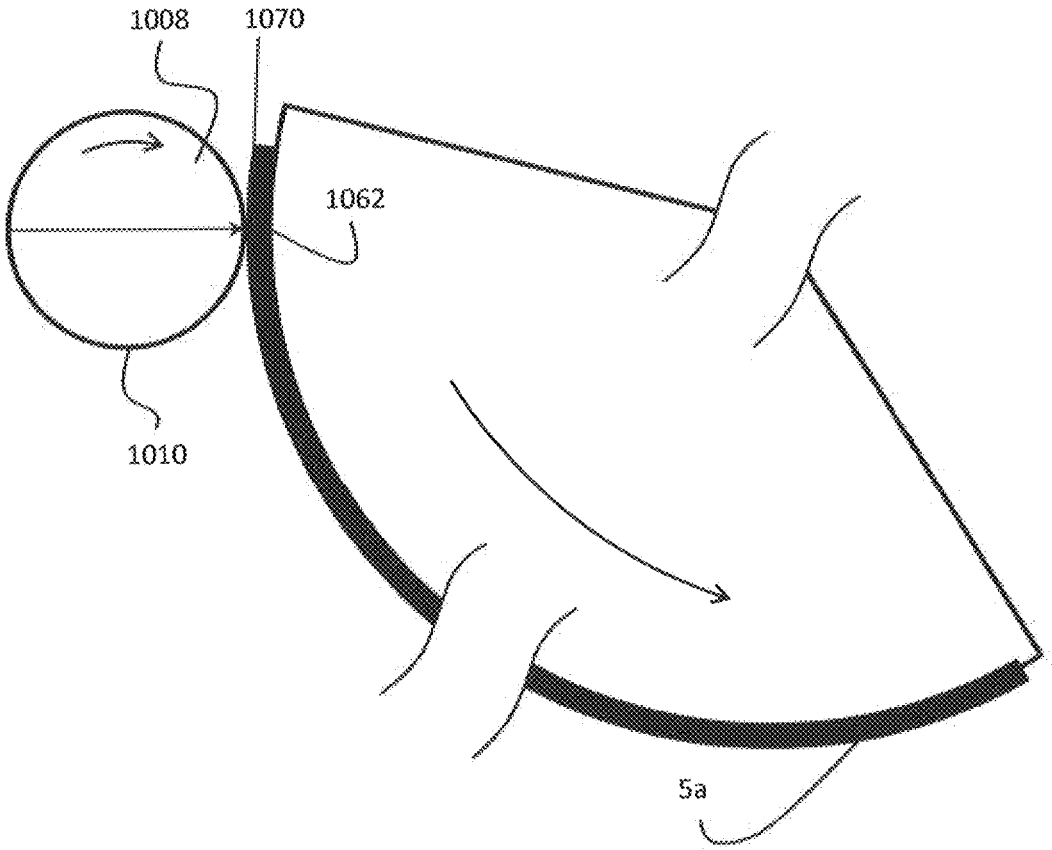
Figure 30:
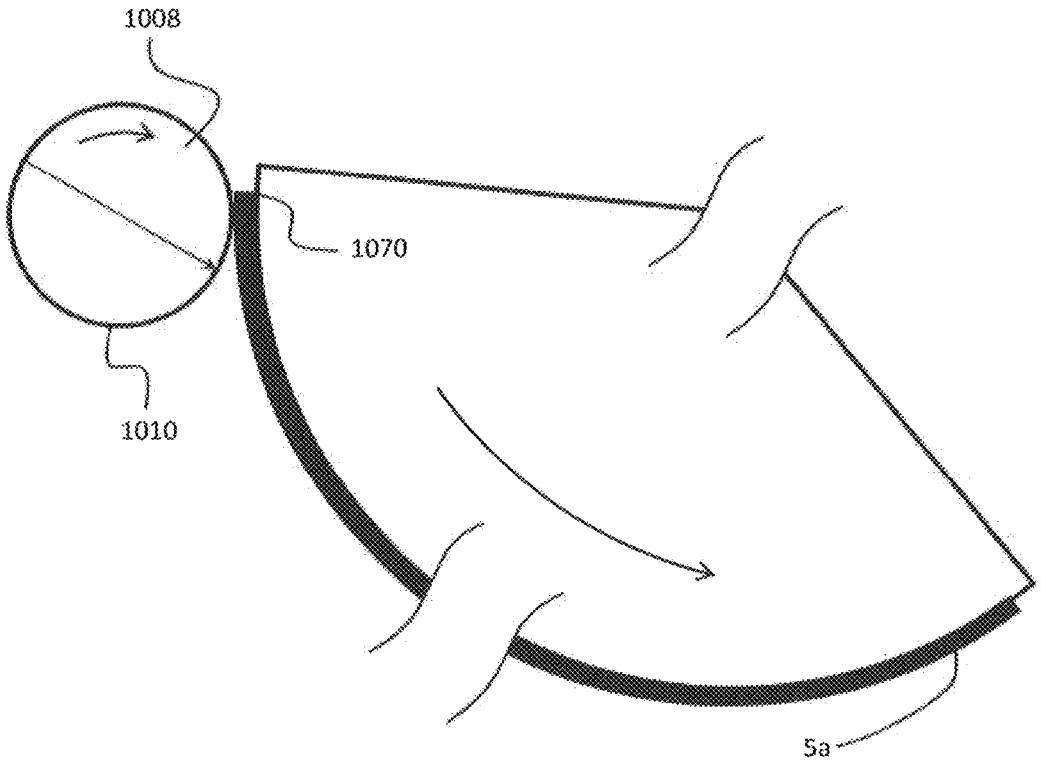
Figure 31:
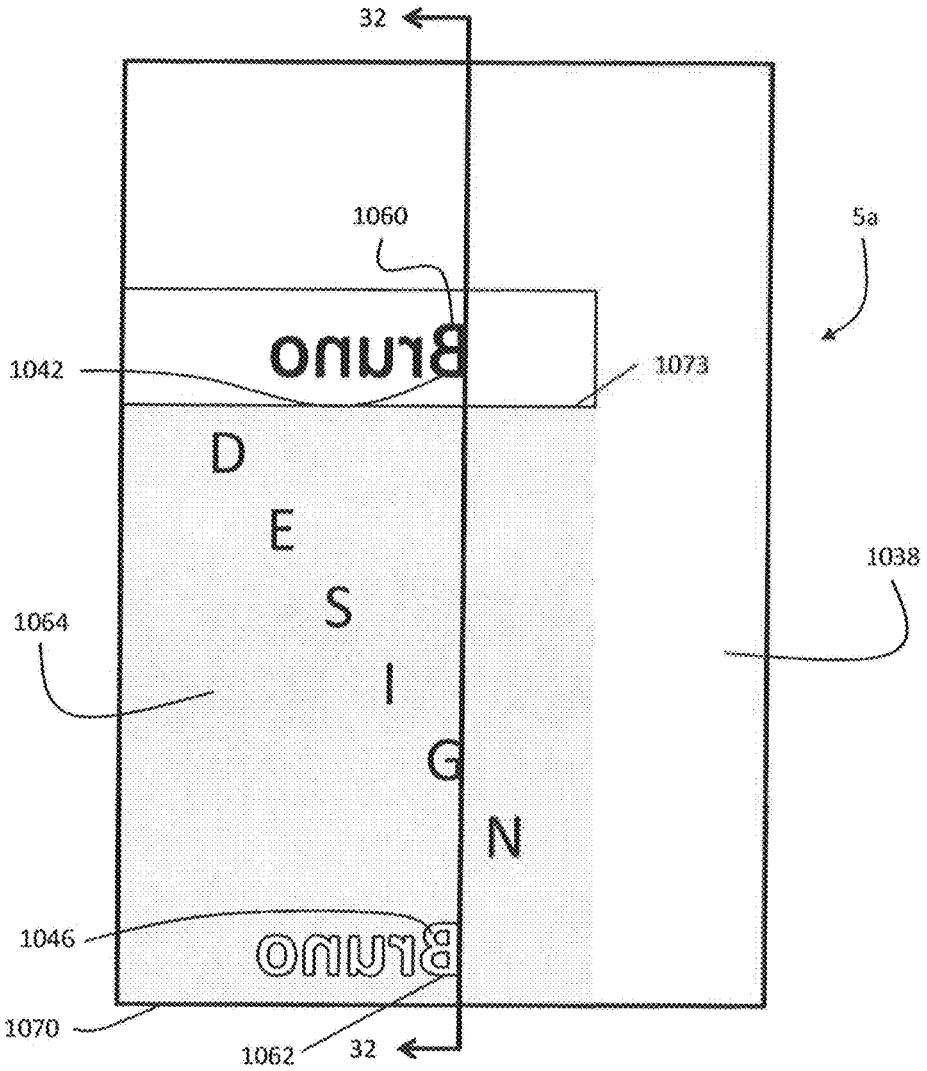
FIG. 31 is a top view of an image transfer blanket having ink applied thereto.
Figure 32:
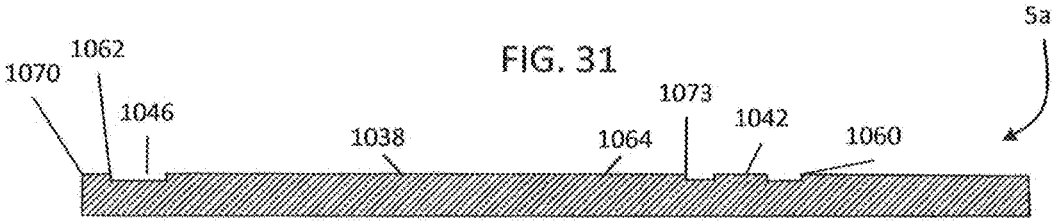
FIG. 32 is a cross-section of an image transfer blanket of FIG. 31.
Figure 33:
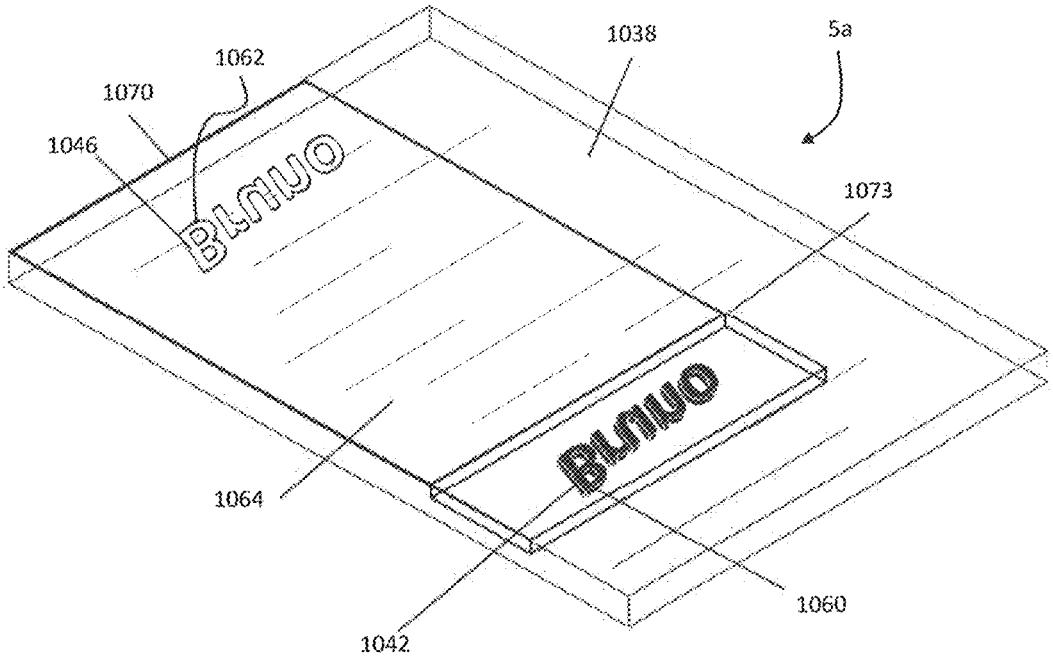
FIG. 33 is a perspective view of an image transfer blanket.
Figure 34:
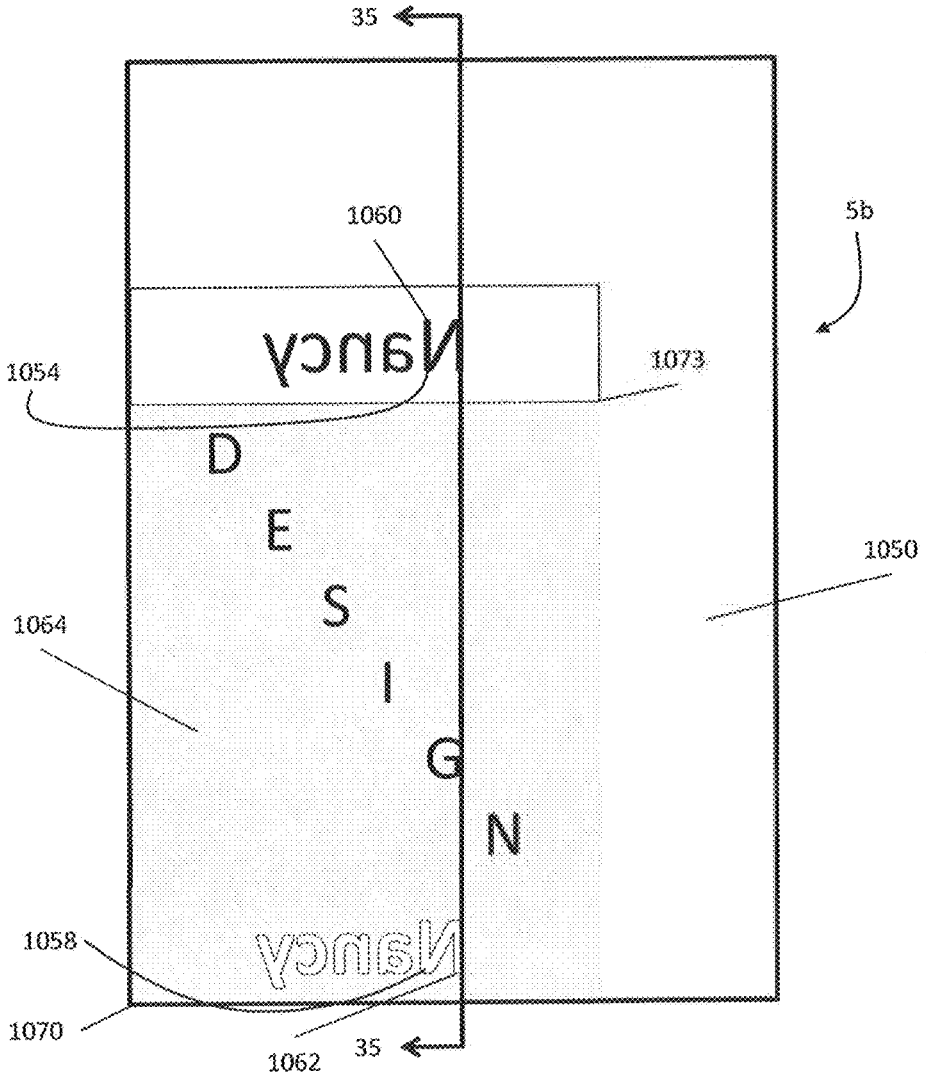
FIG. 34 is a top view of an image transfer blanket having ink applied thereto.
Figure 35:
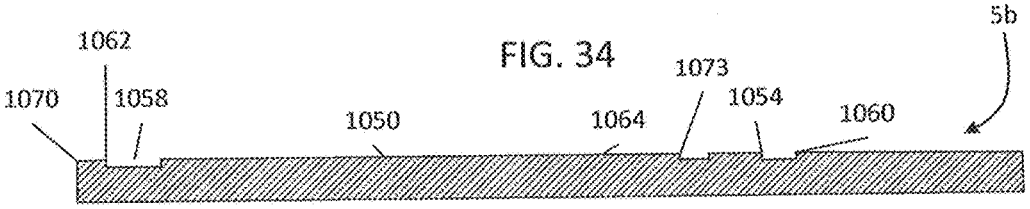
FIG. 35 is a cross-section of the image transfer blanket of FIG. 34.

FIG. 24 shows an example of three sequentially produced, i.e. directly consecutive without manufacturing interruption, beverage containers which may be produced having highly detailed unique art, relative to each other. These cans have gray scale art produced with three unique blankets 5*a*-5*c* according to the present invention. Note that much of the detail is achieved by way of the natural metallic color of the metallic can produced by low relief features on the blankets 5*a*-*c*. In this example, at least one of the printing plates has a relatively large portion of the upper surface in high relief. If the blankets 5*a*-*c* were typical blankets used in the art, the cans would have no art other in an area of the can sidewall corresponding to the high relief portion of the printing plate other than an overall black color. In other words, but for the relief art on the blankets 5*a*-5*c*, the cans would at least have a very large black portion. However, when blankets 5*a*-5*c* according to the present invention are employed having low relief features, the cans exhibit art in a color combination comprising the background color (black) and highly detailed unique art formed by the original color of the can. This is accomplished by the printing plate having substantially a large area of an upper surface in high relief with ink deposited thereon which delivers the ink to high relief portions of the blanket (black). The blanket has highly detailed unique art laser etched thereon in low relief. The beverage container can otherwise have art detail provided by the remaining printing plates. In other words, each metal beverage container produced in sequence up to a finite number of metal beverage containers, typically less than fifteen, will have a first art identical to the other metal beverage containers in the sequence and a second art unique to the individual metal beverage container.

Even more detailed metal beverage container decoration and images can be created by using an interplay between the high and low relief features on the printing plates 3 with the high and low relief features on the transfer blankets 5 together with the colors delivered from the ink cartridges 2. See, for example, FIG. 24.

FIGS. 25A-D are front views of blanket 5*a*-5*d* of the present invention which illustrate how low relief features produced according to the methods described above can be used to generate highly detailed art when used in combination with printing plates as described above. Here, low relief features can be varied in size and location to produce shading and detail which results in a very complex image. According to further principles of the invention, a plurality of unique blankets can be introduced into a rotary inking apparatus as described above wherein a corresponding plurality of different resultant cans can be produced continuously and sequentially. For example, in the blanket illustrated, a man's face is depicted. In practice, the can printing apparatus may be outfitted with a plurality of blankets 5*a*-5*d*, e.g. four, wherein each exhibit unique low relief features, relative to each other, to produce 4 cans sequentially, wherein each of the four cans has a different art thereon, for instance four different men's faces in the example illustrated. It should be noted that the number of different sequentially produced cans is only limited by the number of blankets a particular printing apparatus is capable of using. In the previous example, as few as two and as many as twenty-four different sequentially produced cans may be produced continuously.

More particularly to FIGS. 25A-D, each blanket 5*a*-5*d* has been treated with a laser to remove portions of an upper surface 84 of each blanket 5*a*-5*d*. Using a laser having a laser beam spot size less than 0.002 inches (0.05 mm) very precise removal of the blanket material can produce micro high relief and low relief portions 88,92 of the upper surface 84 of the blankets 5*a*-5*d*. A black ink has been applied to the upper surface 84 of the blankets 5*a*-5*d*. It follows that the high relief features 88 are black in the figures, and the low relief features 92 are a lighter color. The resultant sequentially and continuously printed cans have unique art heretofore unrealized in the can making art.

Consecutively Manufactured Metallic Beverage Container Bodies

Using the principles described above and the further principles yet to be described, a plurality of metallic beverage container bodies 1008 are produced on a dry offset metallic beverage container body decorating apparatus directly consecutively and continuously without manufacturing interruption in a direct single file queue. A first container body 1008 in the queue of container bodies will have one or more unique design elements that are visually distinguishable, as in casting different visual impression, relative to a directly subsequently produced substantially identical container body 1008 (i.e. conforming with typical manufacturing tolerances). Pairs of these consecutively decorated container bodies 1008 are illustrated, for example, in FIGS. 36 and 37, 40 and 41, and 44 and 45. These containers 1008, although produced consecutively, have different overall decorations provided by design elements that are unique to the individual containers 1008 in the pair.

Each of the container bodies 1008 has an open end 1002 separated from a closed end 1006 by a circumferential side wall 1010. The circumferential side wall 1010 has an inner surface and an opposing outer surface 1014. The outer surface 1014 has a surface area that generally defines a surface area of the container body 1008 on which design elements may be applied.

A first container body 1008 in the pair has a common design element 1018 on the outer surface 1014, a first unique design element 1022 in a first color on the outer surface 1014 defined by a first unique design element surface area, and a second unique design element 1026 in a second color on the outer surface 1014 defined by a second unique design element surface. The first unique design element surface area is located within the second unique design element surface area A second container body 1008 in the pair also has the common design element 1018 on its outer surface 1014. a third unique design element 1030 in the first color on the outer surface 1014 defined by a third unique design element surface area, and a fourth unique design element 1034 in the second color on the outer surface 1014 defined by a fourth unique design element surface area. The third and fourth unique design elements 1030,1034 are unique relative to the first and second design elements 1022,1026 on the first container body 1008. Further, the third unique design surface area is located within the fourth unique design surface area.

The unique design elements on the beverage container bodies 1008 owe their relative uniqueness from the first container body 1008 to the second container body 1008 to unique design elements in high and low relief on image transfer blankets 5-*l*. The high relief portions receive ink from printing plates and display these design elements in the form of colors provided by the ink. The low relief portions do not receive ink from the printing plates and display design elements as an absence of ink wherein the uninked surface of the beverage container body 1008 forms a design element, typically surrounded by a color or colors of the common design element forming a border about the uninked design element.

The common design element 1018 is identical from one container to the next. It has a substantially larger surface area than those of the unique design elements 1022,1026,1030, 1034 wherein it dominates the overall impression of the decorated container bodies 1008. It will generally include a dominant background color. This dominant background color portion of the common design will preferably surround the unique design elements 1022,1026,1030,1034 such that unique design elements 1022,1026,1030,1034 lie entirely within the surface area of the common design element 1018.

As will be described below, the common design elements generally owes their shape, color, and appearance to high relief portions of inked printing plates 3*a*-*h*. This process will be described in more detail below.

Figure 36:
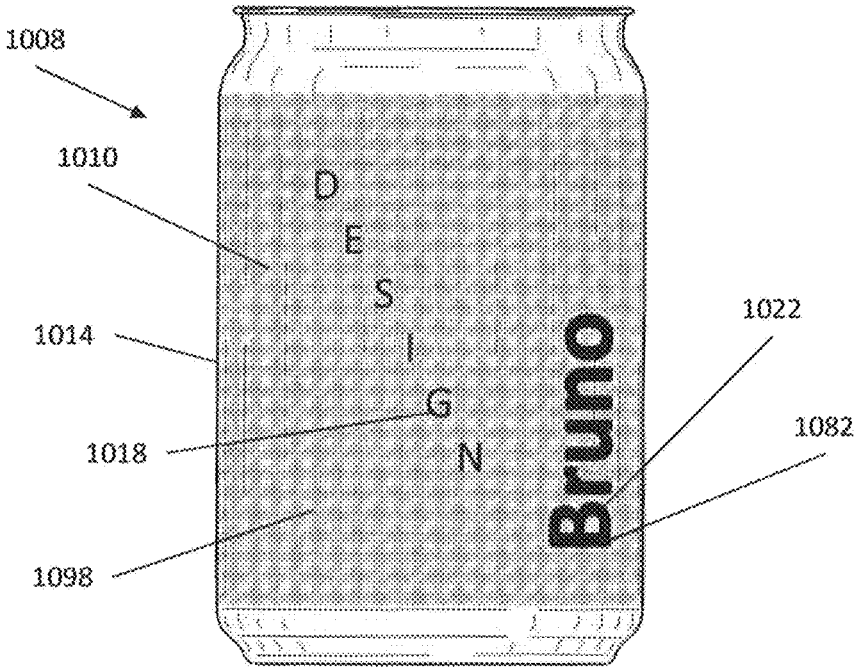
FIGS. 36 and 37 are side views of consecutively produced and decorated metallic beverage container bodies using image transfer blankets made according to the principles of FIGS. 31 and 34, respectively.
Figure 37:
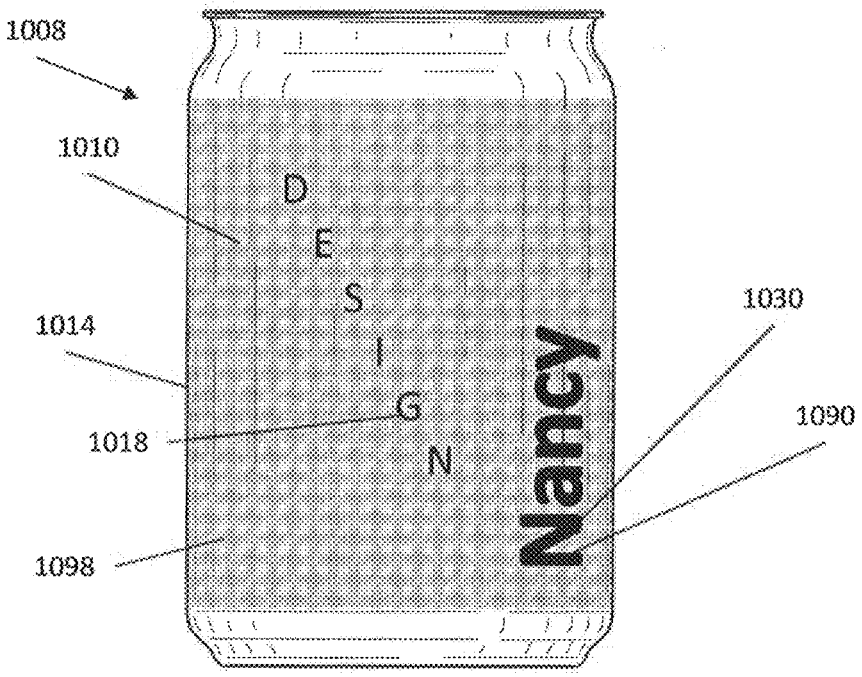
Figure 38:
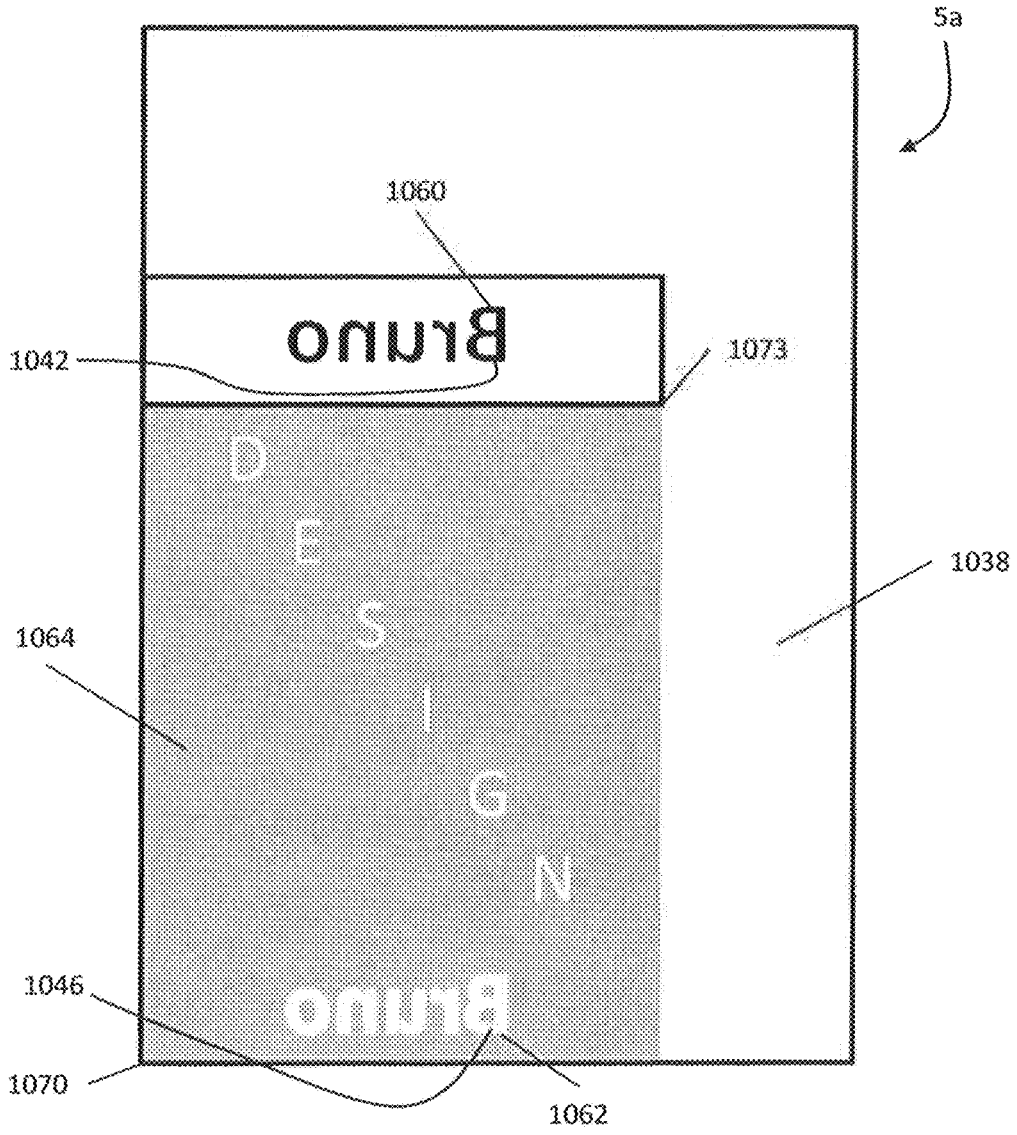
FIG. 38 is a top view of an alternative form of an image transfer blanket having ink applied thereto.
Figure 39:
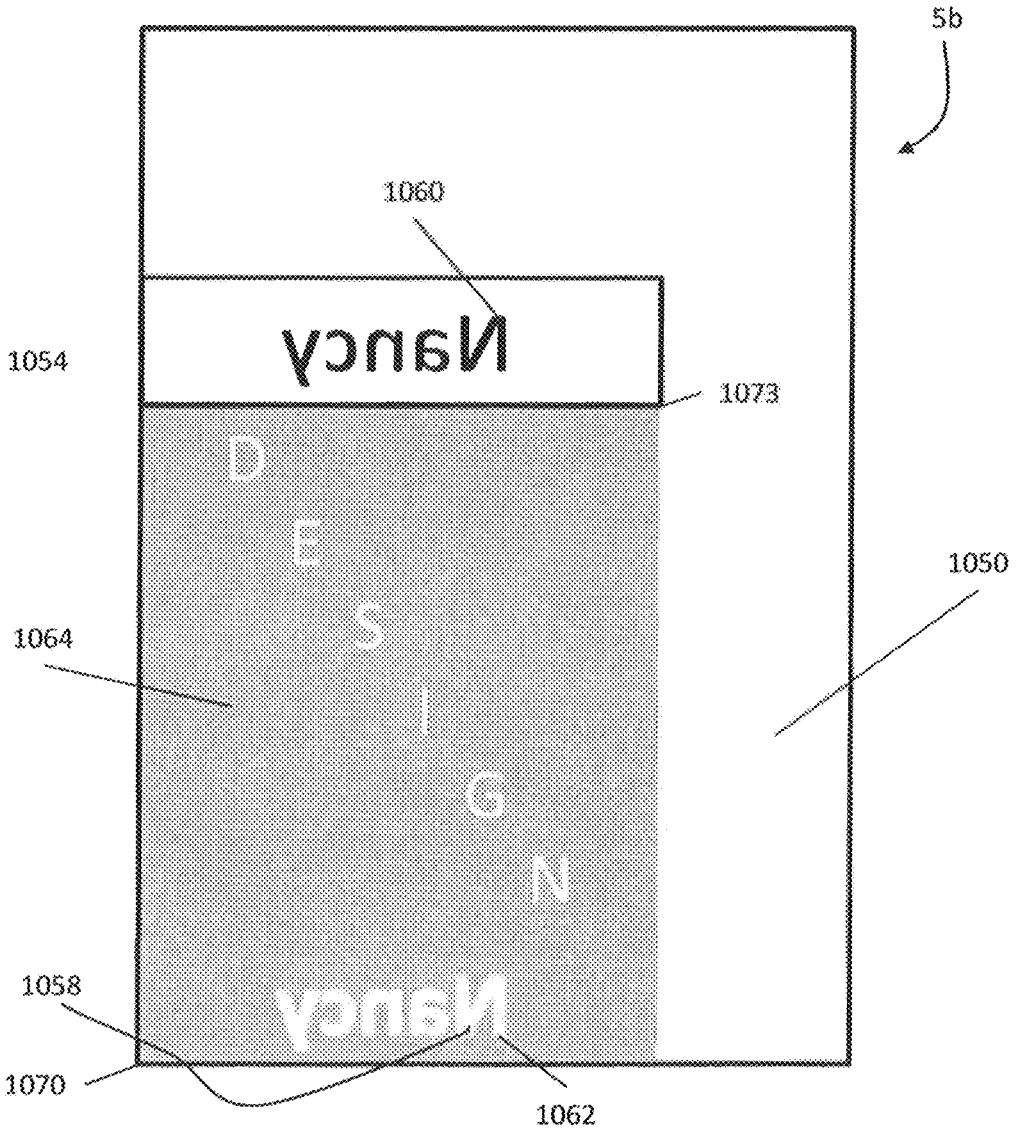
FIG. 39 is a top view of an alternative form of an image transfer blanket having ink applied thereto.
Figure 40:
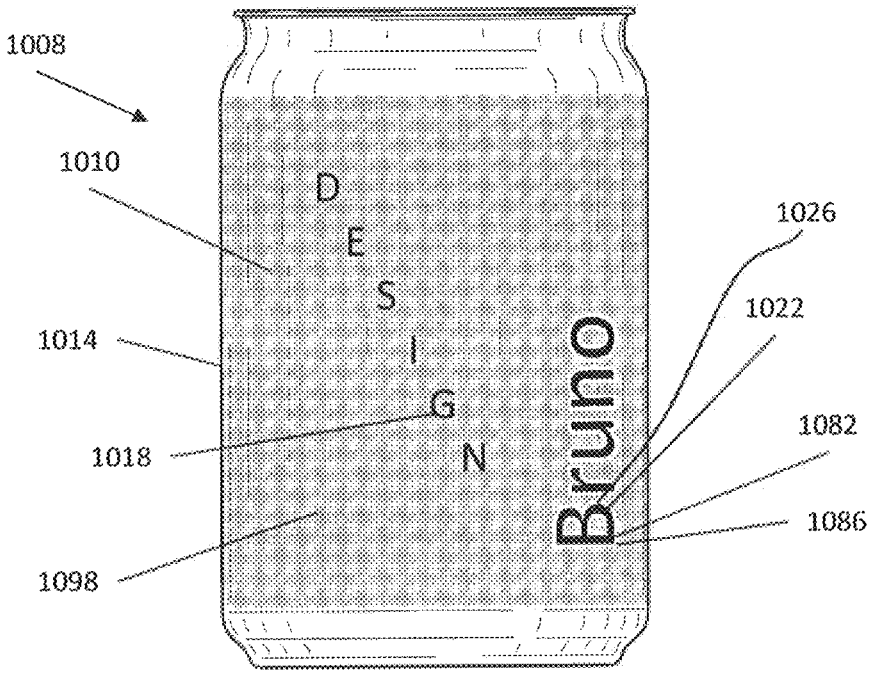
FIGS. 40 and 41 are side views of consecutively produced and decorated metallic beverage container bodies using image transfer blankets made according to the principles of FIGS. 38 and 39, respectively.
Figure 41:
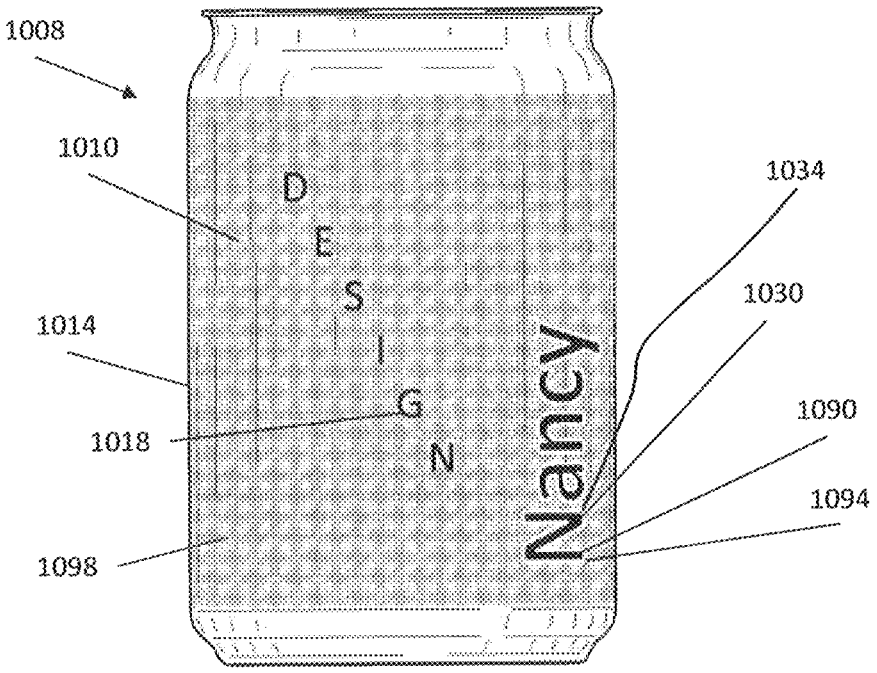
Figure 42:
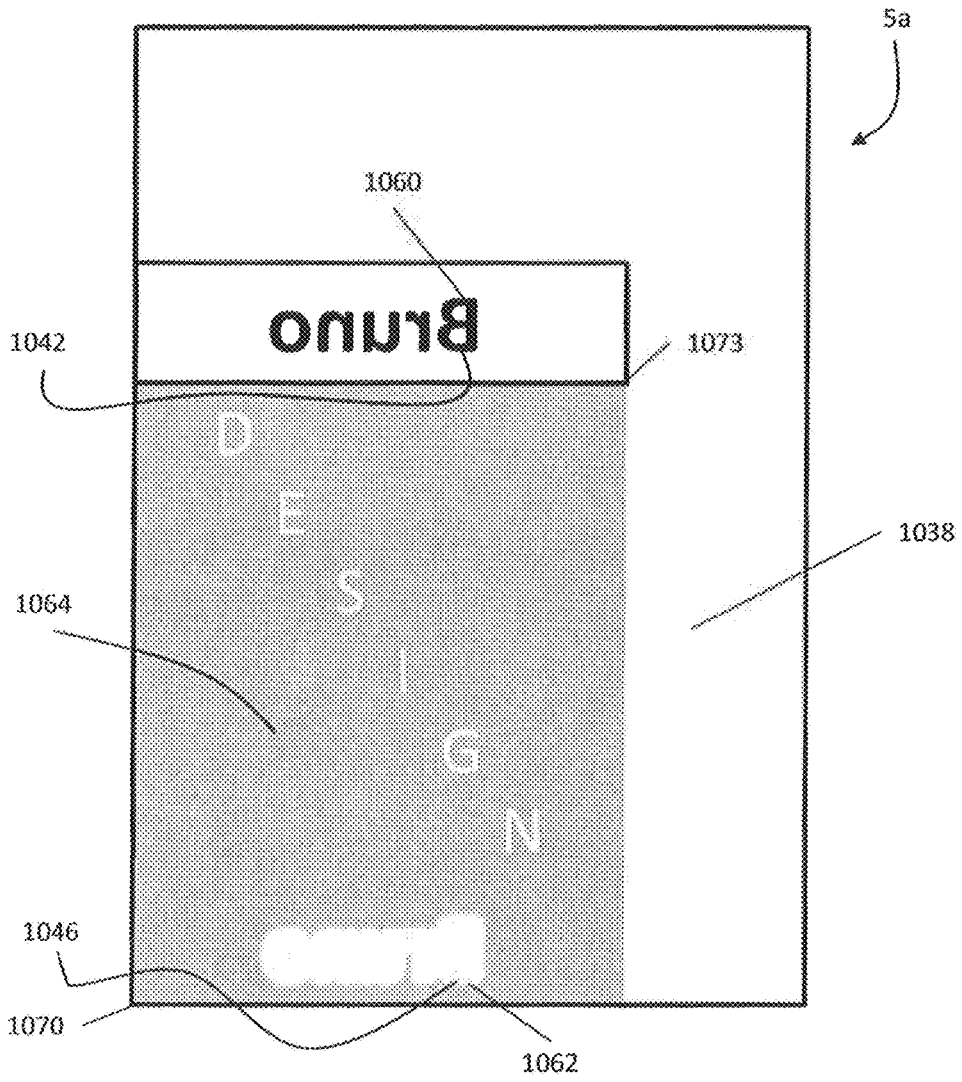
FIG. 42 is a top view of an alternative form of an image transfer blanket having ink applied thereto.
Figure 43:
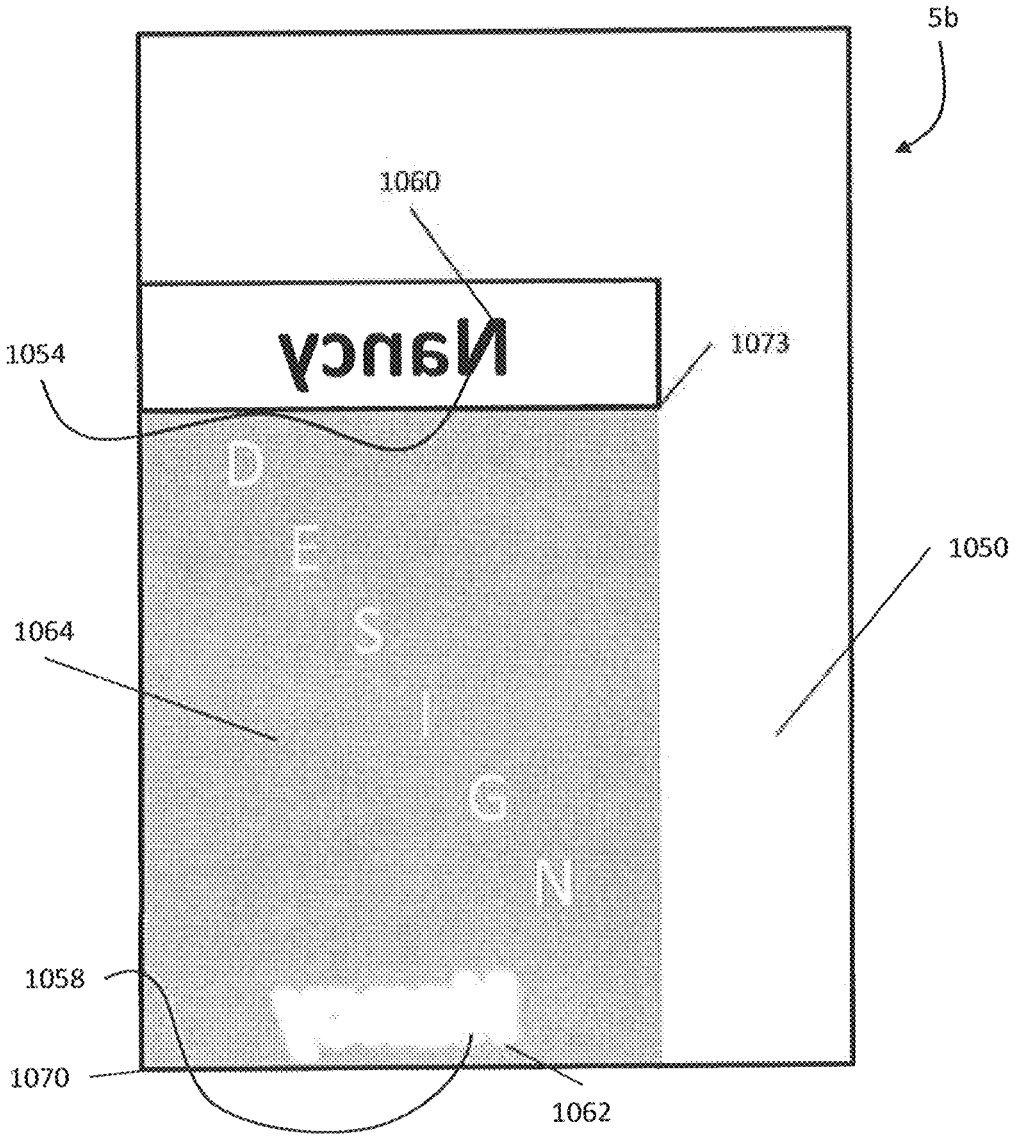
FIG. 43 is a top view of an alternative form of an image transfer blanket having ink applied thereto.

The container bodies 1008 can exhibit several relationships between the pairs of unique design elements 1022, 1026 and 1030,1034. For example, as illustrated in FIGS. 40 and 41 and 44 and 45, the first and third unique design element surface areas are located completely within boundaries of the second and fourth unique design element surface areas, respectively, and the first and third unique design element surface areas are greater than the second and fourth unique design element surface areas, respectively. As illustrated in FIGS. 36 and 37, the first and third unique design element surface areas can be substantially equal to the second and fourth unique design element surface areas, respectively, or the first and third unique design element surface areas can be less than the second and fourth unique design element surface areas, respectively.

Figure 44:
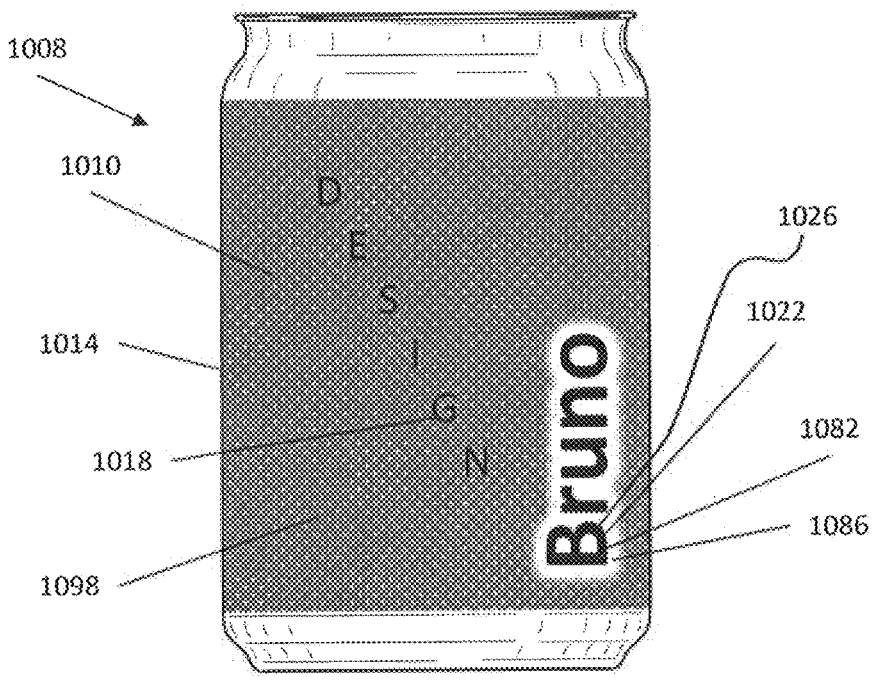
FIGS. 44 and 45 are side views of consecutively produced and decorated metallic beverage container bodies using image transfer blankets made according to the principles of FIGS. 42 and 43, respectively.
Figure 45:
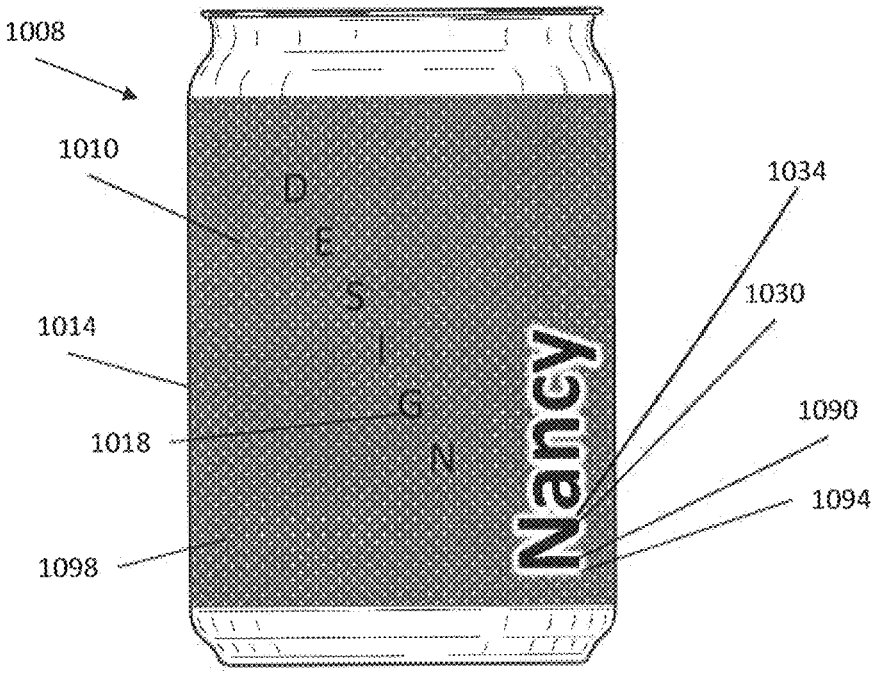

In the illustrated examples, the first and third unique design elements 1022,1030 are alphanumeric characters. The second and fourth unique design elements 1026,1034 are alphanumeric characters in the examples shown in FIGS. 36 and 37 and 40 and 41. In FIGS. 44 and 45, the second and fourth design elements are create borders about the alphanumeric characters of the first and third unique design elements 1022,1030, preferably with half-tone accenting or shading. Preferably, the first and second container bodies have multiple alphanumeric characters that spell out words, such as names and the like.

Further to the examples, the second and fourth design elements 1026,1034 each take the color of an uninked outer surface 1014 of the first and second container bodies 1008. Typically, this uninked portion is the metallic color of the container body 1008. Meanwhile, the first and third design elements 1022,1030 each take a color of an ink supplied to the outer surface 1014 of the first and second container bodies 1008.

Figure 55:
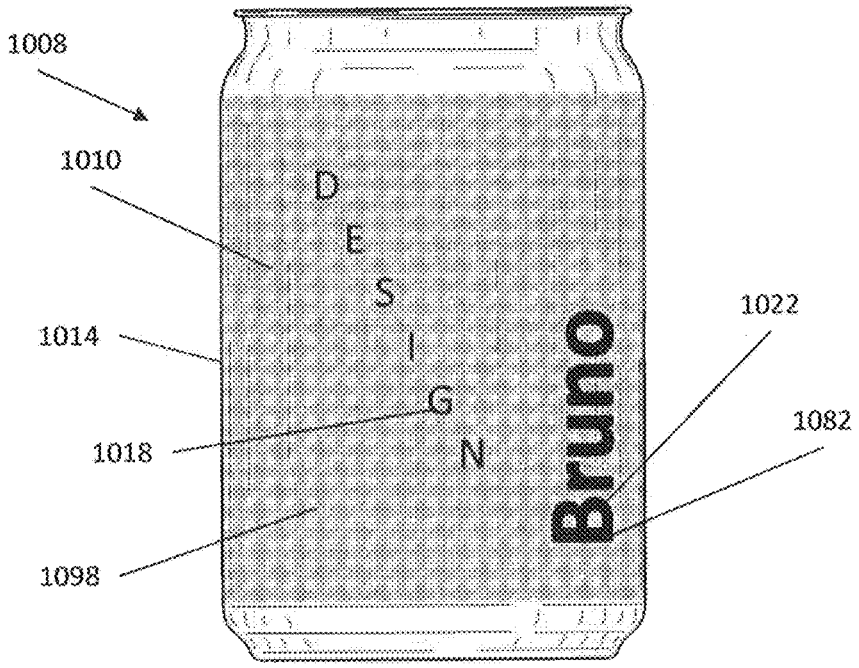
FIGS. 55 and 56 are side views of consecutively produced and decorated metallic beverage container bodies using image transfer blankets made according to the principles of FIGS. 50 and 53, respectively.
Figure 56:
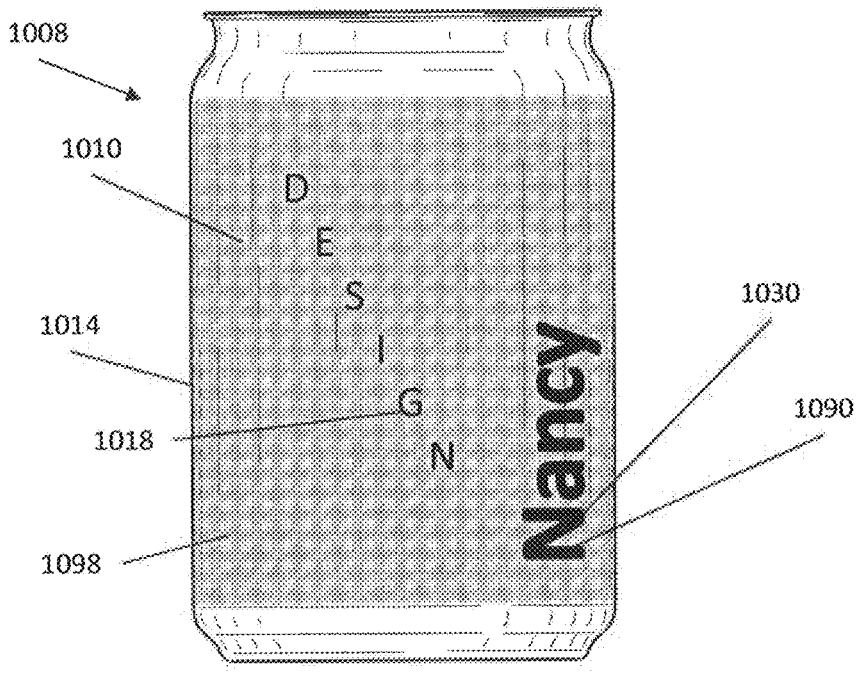

In one embodiment, according to FIGS. 55 and 56, the first and second metallic beverage container bodies receive a wet ink on wet ink process. Here, the second and fourth unique design elements 1026,1034 are completely absent. The ink associated with the first and third design elements 1022,1030 is overlapped directly with an ink associated with the common design element 1018.

The apparatuses and processes that create these decorative structures will be described in detail below.

Dry Offset Rotary Decorating Apparatus

A dry offset rotary style decorating apparatus 1 for creating the decorated beverage container bodies 1008 described immediately above is a typical decorating apparatus as previously described with modifications as will now be described. These modifications are made to at least one of the printing plates 3*a*-*h* (see FIGS. 46-48) and to the image transfer blankets 5*a*-*l*.

The purpose of this apparatus 1 is to deliver a first overall decoration comprising unique design elements and a common design element from one image transfer blanket 5*a* to a first metallic beverage container body 1008. The apparatus 1 then delivers a second overall decoration comprising different unique design elements and the same common design element from a second image transfer blanket 5*b* to a second consecutively processed metallic beverage container body 1008. The first overall decoration is, thus, unique relative to the second overall decoration caused by the unique design elements.

In this embodiment, the differences between the first overall decoration and the second overall decoration are accomplished by over-rotation of the container bodies 1008 against ink-bearing portions of the image transfer blankets 5*a*-*l*. In other words, the container bodies will make more than a 360 rotation against ink-bearing portions of the image transfer blankets 5*a*-*l*.

As previously set forth, the apparatus has a plurality of ink applicators 2*a*-*h*. A plurality of printing plates 3*a*-*h*, where each printing plate 3*a*-3*h* has a print surface in high relief, engages a corresponding ink applicator of the plurality of ink applicators 2*a-h* and receives a quantity of fluid, i.e. ink, therefrom. The apparatus further comprises a plurality of image transfer blankets 5*a-l* rotationally mounted to the apparatus 1. The image transfer blankets 5*a,b* of this embodiment are illustrated in FIGS. 27-35, 38, 39, 42, 43, 48, and 49.

Figure 48:
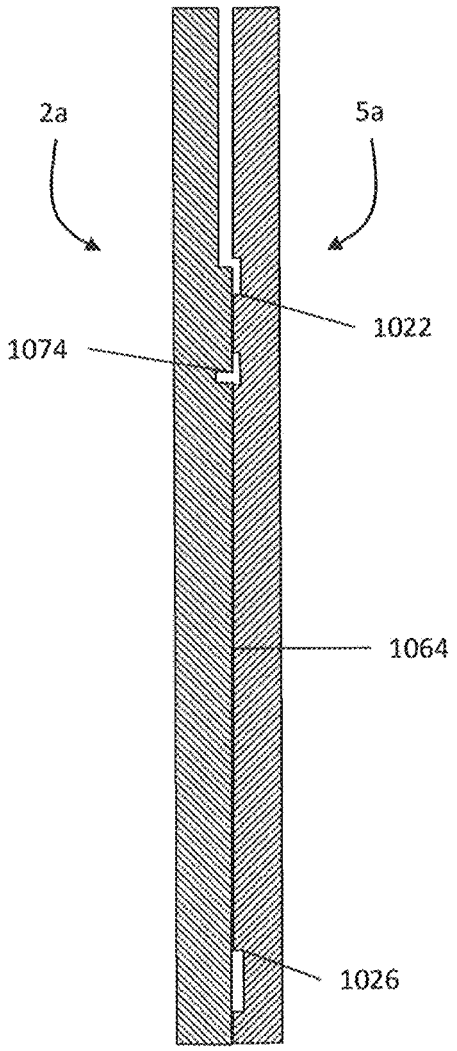
FIG. 48 is a side view of the printing plate of FIG. 46 face-to-face with an image transfer blanket of the present invention.
Figure 49:
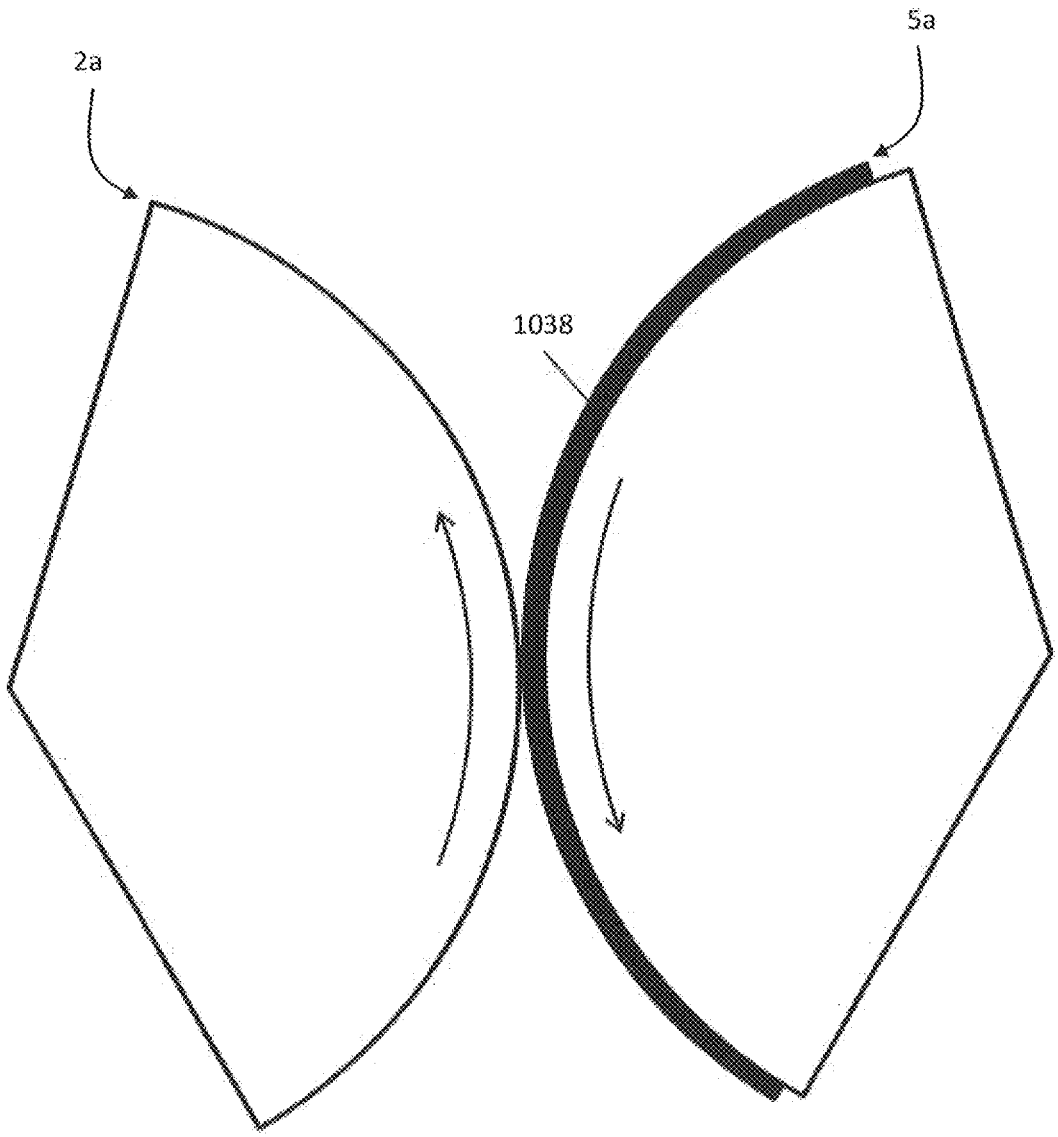
FIG. 49 is a side view of a printing plate in an engagement with an image transfer blanket and transferring ink thereto.
Figure 50:
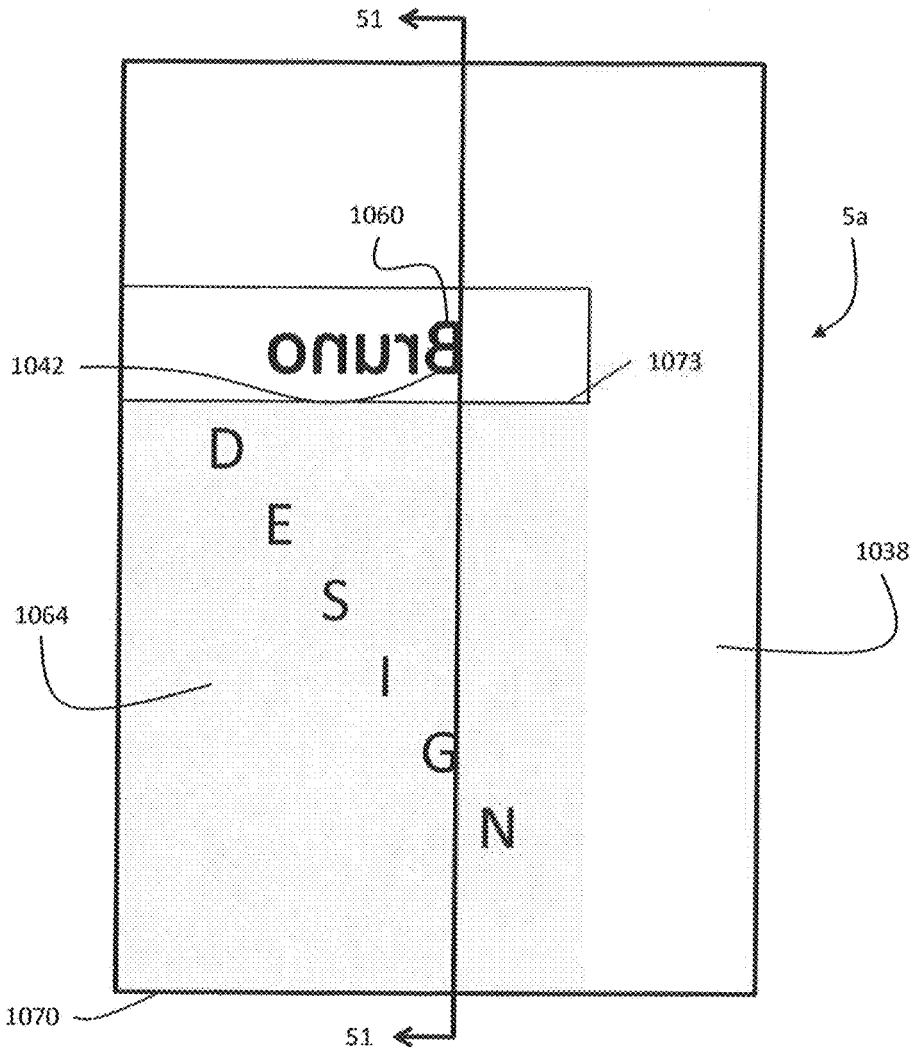
FIG. 50 is a top view of an image transfer blanket having ink applied thereto.
Figure 51:
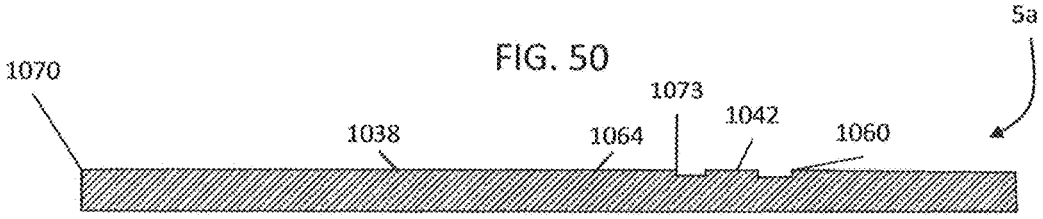
FIG. 51 is a cross-section of an image transfer blanket of FIG. 50.
Figure 52:
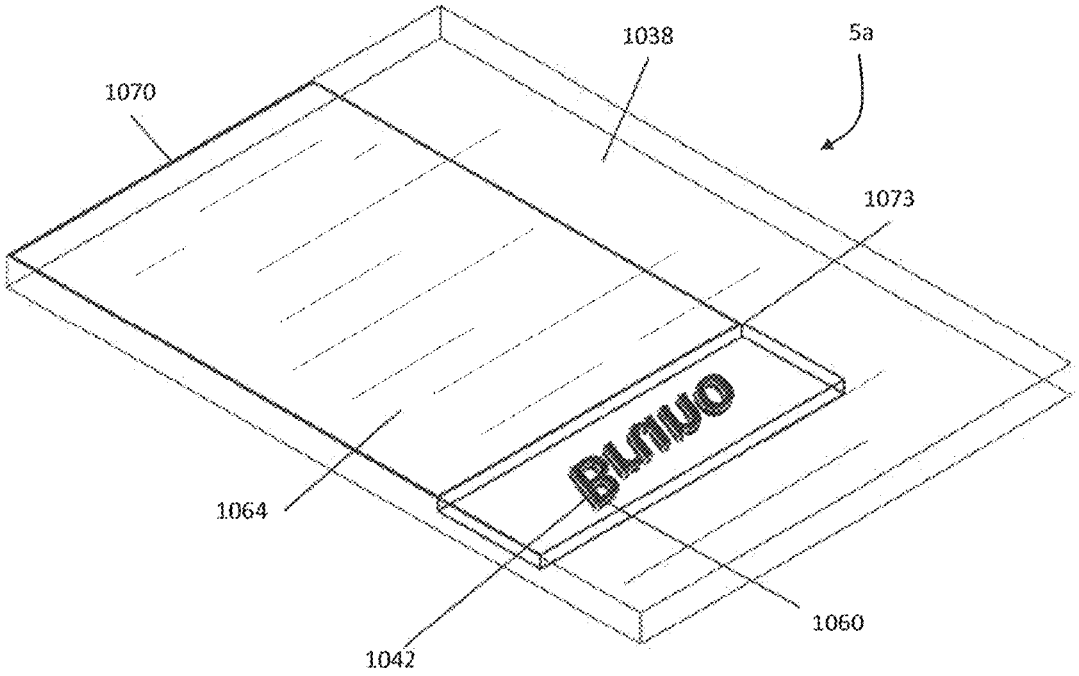
FIG. 52 is a perspective view of an image transfer blanket.
Figure 53:
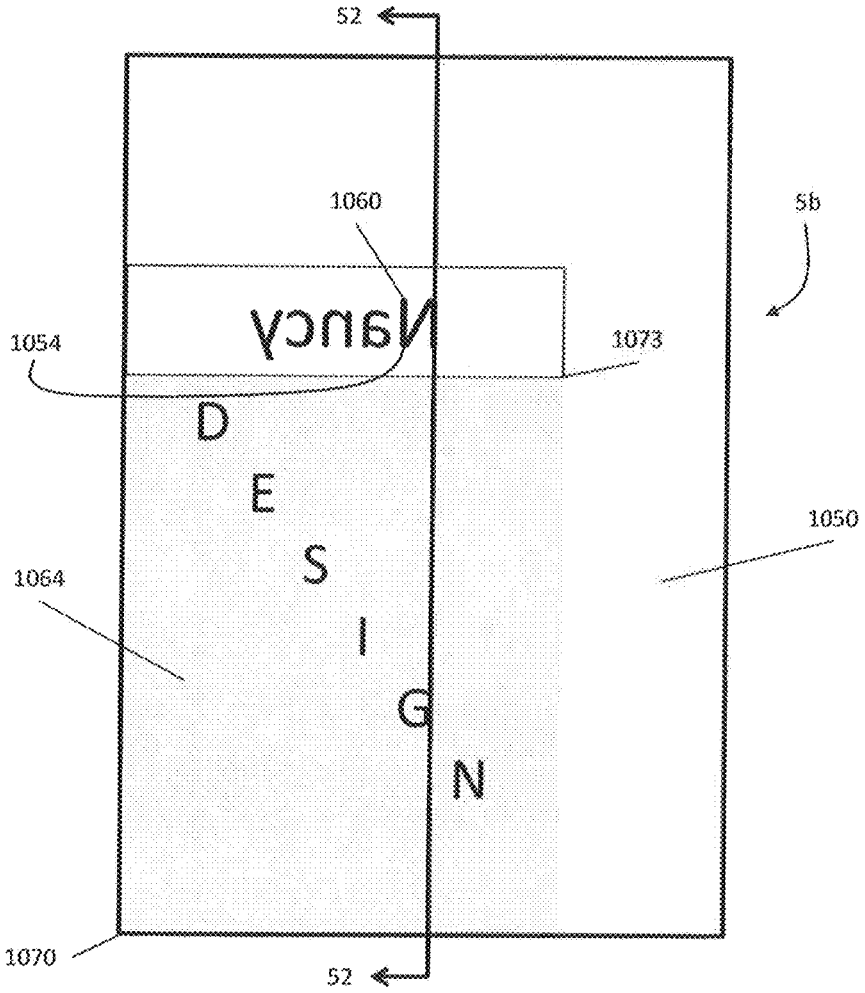
FIG. 53 is a top view of an image transfer blanket having ink applied thereto.
Figure 54:
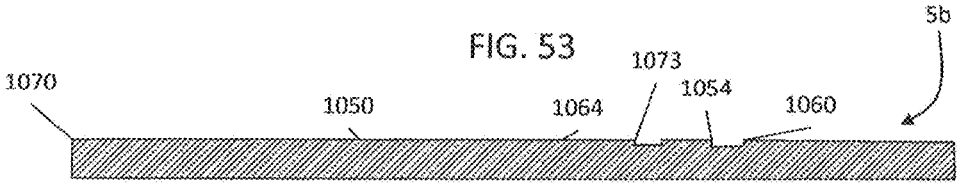
FIG. 54 is a cross-section of the image transfer blanket of FIG. 53.

One image transfer blanket 5*a* has an ink receiving surface 1038. The ink receiving surface 1038 sequentially engages each print surface of the plurality of printing plates 3*a-h*. High relief portions of the printing plates 3*a-h* engage high relief portions of the image transfer blankets 5*a-l* as illustrated in FIGS. 48 and 49. A first unique design element 1042 is in high relief relative to directly adjacent portions of the ink receiving surface 1038 bordering the first unique design element 1042. A second unique design element 1046 is in low relief within the ink receiving surface 1038. It is important to keep at least a 3 mm spacing between the second unique design element 1048 and any artwork apart from a background color of a common design element transferred from the printing plates 3*a-h* to the image transfer blankets 5*a-l*.

Similarly, a second image transfer blanket 5*b* has a second ink receiving surface 1050. It engages the printing plates 3*a-h* in a like manner. A third unique design element 1054 is in high relief relative to directly adjacent portions of the second ink receiving surface 1050 bordering the third unique design element. The third unique design element 1054 is unique and distinctive relative to the first design element 1042 on the first image transfer blanket 5*a*. A fourth unique design element 1058 is in low relief within the second ink receiving surface 1050.

The beverage container indexer 11 is mounted to the apparatus 1 in the conventional manner. The indexer 11 is rotationally mounted to the apparatus 1 and has a plurality of stations adapted for receiving a metallic beverage container body 1008 therein. The indexer 11 delivers the container bodies 1008 sequentially and continuously to a printing site 15 where the container bodies 1008 rotationally engage one image transfer blanket 5*a* such that the circumferential side wall 1010 of the container body 1008 completes at least a full 360 degree rotation, preferably more rotation as will be described, against the ink receiving surface 1038 and receives ink therefrom at the printing site 15. The indexer 11 transfers a container body 1008 from the printing site 15 while simultaneously transferring another container body 1008 to the printing site 15 where this container body engages a second single image transfer blanket 5*b* such the circumferential side wall 1010 of this container body 1008 also completes at least a full 360 degree rotation against ink receiving surface 1050 of the second image transfer blanket 5*b* and receives ink therefrom.

In this embodiment of the invention, as illustrated in FIGS. 27-30, the container bodies 1008 complete more than a 360 degree rotation against ink-bearing portions of the ink receiving surfaces 1038,1050 of the image transfer blankets 5*a,b*. Typically, this additional rotation will be at least 6.5 rad, more preferably at least 6.6 rad, or enough to cause the surface areas of the first and third unique design elements 1042,1046 and the surface areas of the second and fourth unique design elements 1054,1058, respectively, to overlap during printing of the container bodies 1008. Accordingly, a distance between leading edges 1060 of the first and third design elements 1042,1054 and trailing edges 1062 of the second and fourth design elements 1046,1058 along a path parallel with a rotational movement of the image transfer blankets 5*a,b* are within ±10% of a length of a circumference of the metallic beverage containers processed on the apparatus 1.

The ink receiving surfaces 1038,1050 on the image transfer blankets 5*a-l* also have an identical common design element 1064 in high relief. This common design element 1064 is created by the transfer of ink from high relief portions of the printing plates 3*a-h* to high relief portions of the ink receiving surfaces 1038,1050, in the embodiment illustrated. A distance between the leading edges 1060 of the first and third design elements 1042,1054 and a trailing edge 1070 of the common design element 1064 on the first and second ink receiving surfaces 1038,1050 is greater than or equal to a circumferential length of the container bodies plus a length of an arc of the container bodies 1008 subtending an angle of 15°, more preferably 20° or more. This arrangement allows the overlap of the surface areas of the unique design elements when the container bodies are over-rotated more than one complete revolution against ink-bearing surfaces of the image transfer blankets 5*a-l*.

Thus, in the particular embodiment described herein, as the first and second container bodies 1008 are over-rotated more than one complete revolution against the ink receiving surfaces 1038,1050, they will first encounter an ink-bearing leading edge of the first and third unique design elements 1042,1054 in high relief. Trailing edges 1072 of the first and third unique design element 1042,1054 are separated from a leading edge 1073 of the common design element on the ink receiving surfaces 1038,1050 by a low relief portion of the ink receiving surface. The container bodies 1008 will then engage ink-bearing portions of the ink receiving surfaces 1038,1050 having the common design element 1064 thereon. A length of the common design element 1064 between the leading edge 1073 of the common design element and the trailing edge of the common design element is within ±5% of the length of the circumference of the container bodies, and the second and third unique design elements 1026,1058 are in low relief between the leading edge 1073 of the common design element 1064 and the trailing edge 1070 of the common design element 1064.

Using the over-rotation of the container bodies 1008 against their respective image transfer blankets 5*a-l*, many decorating variations can be achieved. For example, the first, second, third, and fourth design elements 1042,1046,1054, 1058 are defined by first, second, third, and fourth design element surface areas, respectively. The first and third unique design element surface areas may be less the second and fourth unique design element surface areas, respectively. The first and third unique design element surface areas may be substantially equal to the second and fourth unique design element surface areas, respectively. The first and third unique design element surface areas may be greater than the second and fourth unique design element surface areas, respectively.

As discussed in conjunction with the container bodies 1008 themselves, the unique design elements may be alphanumeric characters. The first and second unique design elements 1042,1046 can be the same character, or the second unique design element 1046 character can create visual effects about the first unique design element 1022 (see FIG. 44). Likewise, third and fourth unique design elements can be the same character, or the fourth unique design element 1058 can create visual effects about the third unique design element 1054 (see FIG. 45). Clearly, from the drawings, the unique design elements 1042,1046,1054,1054 may comprise a plurality of alphanumeric characters each in order to spell names and the like.

Figure 46:
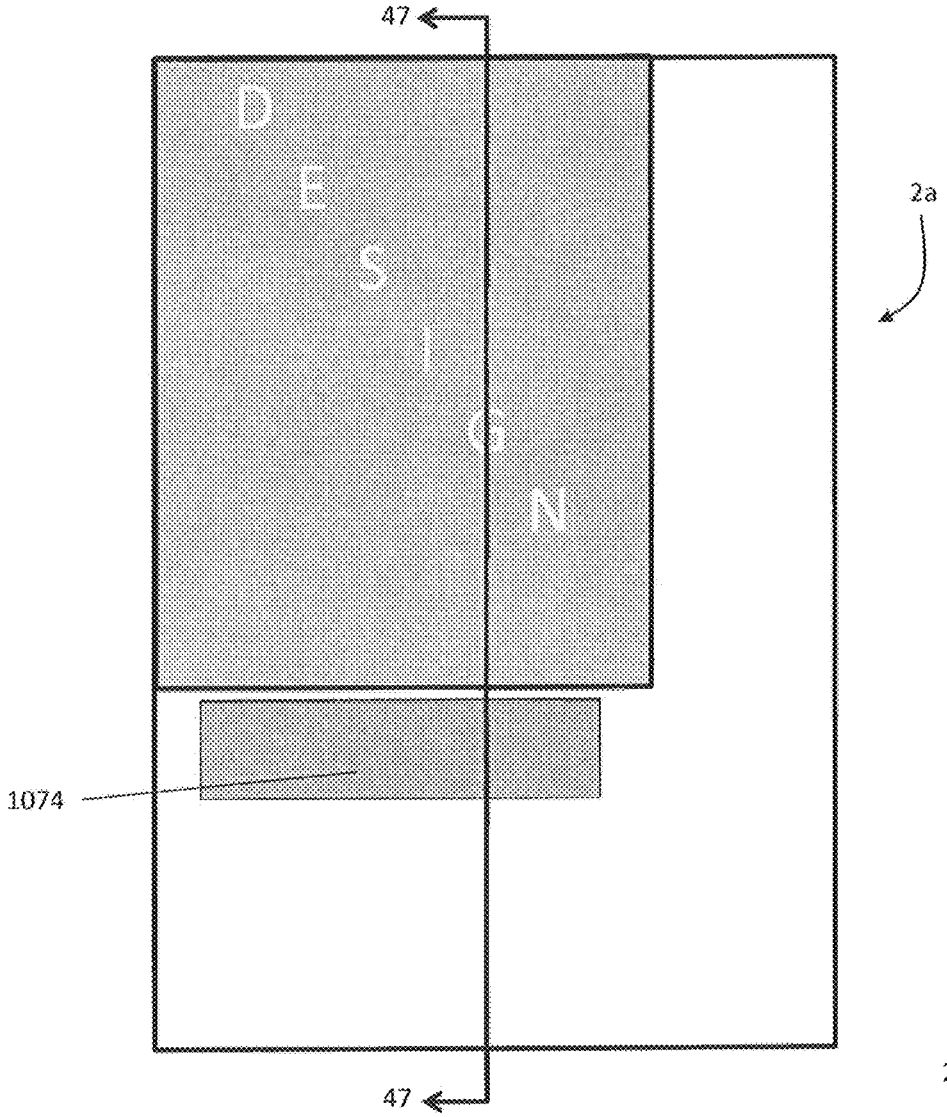
FIG. 46 is a top view of a printing plate with ink thereon.
Figure 47:
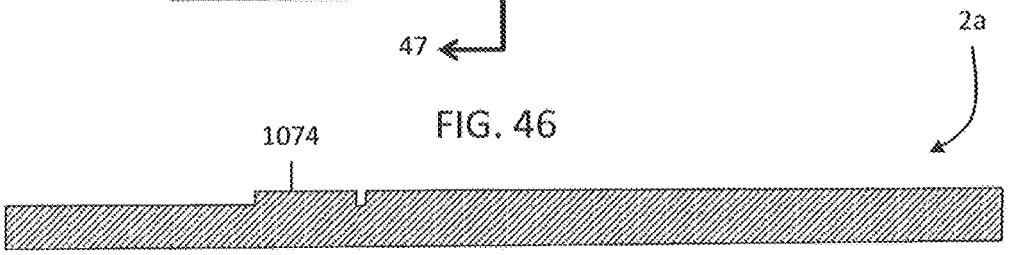
FIG. 47 is a cross-section view of the printing plate of FIG. 46.

As shown in FIGS. 46 and 47, in this embodiment, one of the printing plates 3*a* has a band 1074 in high relief. This band 1074 engages the high relief of the first and third unique design elements 1042,1054 on the image transfer blankets 5*a,b* (see, e.g., FIG. 48).

In one embodiment, according to FIGS. 50-56, the apparatus featuring over-rotation of the metallic beverage container bodies 1008 described above is used to print in a wet ink on wet ink process. Here, the second and fourth unique design elements 1042,1058 are not included on the first and second blankets 5*a,b* such that an ink from the ink patterns 1082,1090 received on the containers bodies 1008 from the first and third unique design elements 1042,1058 is overlapped directly with an ink of the ink pattern 1098 received from the common design element 1064.

Method of Processing Container Bodies

The invention is further directed to a method of producing the metallic beverage container bodies 1008 of, for example, FIGS. 36 and 37, on an apparatus 1 as described above using the principles of container body over-rotation, the unique and common design elements of the image transfer blankets, and the printing plate band 1074 described in conjunction with FIG. 48. Accordingly, the method is directed to consecutively decorating a plurality of substantially identical metallic beverage container bodies using a dry offset decorating apparatus. This method is carried out without manufacturing interruption.

Thus, a queue of the container bodies 1008 is sequentially indexed to and through a printing site 15 on the dry offset decorating apparatus 1. As shown in FIGS. 27-30, a circumferential side wall 1010 of a first metallic beverage container body 1008 is brought into contact with the first ink receiving surface 1038 of the first image transfer blanket 5*a*. The first metallic beverage container body circumferential side wall 1010 is rotated at least 6.5 rad, more preferably at least 6.6 rad, while engaged with ink-bearing portions of the first ink receiving surface 1038 and along a length of the first ink receiving surface 1038 greater than a circumferential length of the first metallic beverage container body circumferential side wall 1010. Next, this process is repeated for a second metallic beverage container body 1008 directly behind the first metallic beverage container body 1008 in the queue, although contact of this container body 1008 is with a second image transfer blanket 5*b*.

The first metallic beverage container body 1008 will have a resultant overall decoration that is unique relative to a resultant overall decoration exhibited by the second metallic beverage container body 1008 subsequent to the two engaging and rotating steps.

Furthermore, according to the description of the first image transfer blanket 5*a*, the first unique design element 1042 is spaced from the second design element 1046 on the first ink receiving surface 1038. Rotation of the first metallic beverage container circumferential side wall 1010 by at least 6.2 radians against and along a length of the first ink receiving surface 1038 causes a first ink pattern 1082 associated with the first unique design element 1042 to be deposited on the first metallic beverage container side wall 1010 and causes a second ink pattern 1086 associated with the second unique design element 1046 to be deposited on the first metallic beverage container side wall 1010. The first ink pattern 1082 and the second ink pattern 1086 overlap.

Likewise, the third unique design element 1054 of the second image transfer blanket 5*b* is spaced from the fourth design element 1058 on the second ink receiving surface 1050 such that the rotation of the second metallic beverage container circumferential side wall 1010 by at least 6.2 radians against and along a length of the second ink receiving surface 1050 causes a third ink pattern 1090 associated with the third unique design element 1054 to be deposited on the second metallic beverage container side wall 1010 and causes a fourth ink pattern 1094 associated with the fourth unique design element 1058 to be deposited on the second metallic beverage container side wall 1010. The third ink pattern 1090 and the fourth ink pattern 1094 overlap.

The image transfer blankets 5*a,b* employed in this method have an identical common design element 1064 on the first and second ink receiving surfaces 1038,1050, respectively, and which forms a boundary around the second and fourth unique design elements 1046,1058 in low relief, respectively. The identical common design elements 1064 on the image transfer blanket blankets 5*a,b* are directly attributable to receiving an ink pattern from the high relief portions of each of the plurality of printing plates 3*a-h* and which directly create the common design element 1018 exhibited by the decorated container bodies 1008.

More specifically, the ink applicators 2*a-h* are each supplied with a different color ink. Each printing plate 3*a-h* has a print surface in high relief. Each of the plurality of ink applicators 2*a*-2*h* transfers a quantity of ink to a corresponding printing plate 3*a-h*. Each of the plurality of printing plates 3*a-h* is then brought into engagement with the first ink receiving surface 1038 of the first image transfer blanket 5*a* to provide a common ink pattern 1098 associated with the identical common design element 1064 and to provide ink to the first unique design element 1042 in high relief prior to engaging the circumferential side wall 1010 of the first metallic beverage container body 1008 with the first ink receiving surface 1038 of the first image transfer blanket 5*a*. This action is repeated on the second image transfer blanket 5*b*.

It further follows that the first and third ink patterns 1082,1090 are defined by first and third ink pattern surface areas, respectively. The second and fourth ink patterns 1086,1094 are defined by second and fourth ink patterns surface areas, respectively. The first and third ink pattern surface areas may be located completely within boundaries of the second and fourth ink pattern surface areas, respectively. (See FIGS. 44 and 45). The first and third ink pattern surface areas may be less than the second and fourth ink pattern surface areas, respectively. (See FIGS. 40 and 41). The first and third ink pattern surface areas may be substantially equal to the second and fourth ink pattern surface areas, respectively. The first and third ink pattern surface areas are greater than the second and fourth ink pattern surface areas, respectively. (See FIGS. 36 and 37). Furthermore, the second and fourth ink patterns 1086,1090 can be defined by an area having absence of ink bordered by the common design element 1064 ink pattern.

In one embodiment, according to FIGS. 50-56, the method of the amount or degree of over-rotating the metallic beverage container bodies 1008 described above is used to print in a wet ink on wet ink process. Here, the second and fourth unique design elements 1042,1058 are not included on the first and second blankets 5*a,b* such that an ink from the ink patterns 1082,1090 received on the containers bodies 1008 from the first and third unique design elements 1042, 1058 is overlapped directly with an ink of the ink pattern 1098 received from the common design element 1064.

A preferred example of embodiment having been described, one should understand that the scope of the present invention embraces other possible variations, being limited only by the contents of the accompanying claims, which include the possible equivalents.

REFERENCE NUMBERS

1: printing apparatus
2*a*-2*h*: ink-holders
3*a*-3*h*: printing plates
4*a*-4*h*: plate cylinders
5*a*-5*l*: transfer blankets
6: transfer blanket drum
7: can chain
8: can
9: first directing wheel
10: first directing wheel
11: can carrying apparatus or beverage container indexer
12: central axle
13*a*-13*c*: artwork in low relief
66: an edge portion forming a transition between each of the plurality of low relief features and each of the corresponding high relief features on a transfer blanket
68: an edge portion forming a transition between opposite the edge 66
70: a wall separating the low relief features from the high relief features on a transfer blanket
80: a complex image exhibiting shading
84: an upper surface of a transfer blanket
88: high relief features on a transfer blanket
92: low relief features on a transfer blanket While the specific embodiments have been illustrated and described, numerous modifications come to mind without significantly departing from the spirit of the invention, and the scope of protection is only limited by the scope of the accompanying Claims.

What is claimed is:

1. A method of consecutively decorating a plurality of substantially identical metallic beverage container bodies using a dry offset decorating apparatus without manufacturing interruption wherein each of the metallic beverage container bodies has an open end separated from a closed end by a circumferential side wall, the method comprising the steps of:

providing a first image transfer blanket comprising:

a first ink receiving surface having a first unique design element in high relief relative to directly adjacent portions of the first ink receiving surface bordering the first unique design element and a second unique design element in low relief within the first ink receiving surface, the first ink receiving surface having a length greater than or equal to a circumferential length of a first metallic beverage container body plus a length of an arc of the first metallic beverage container body subtending an angle of 15°;

providing a second image transfer blanket comprising:

a second ink receiving surface having a third unique design element in high relief relative to directly adjacent portions of the second ink receiving surface bordering the third unique design element and a fourth unique design element in low relief within the second ink receiving surface, wherein the third unique design element is unique relative to the first design element on the first image transfer blanket, the second ink receiving surface having a length greater than or equal to a circumferential length of a second metallic beverage container body plus a length of an arc of the second metallic beverage container body subtending an angle of 15°;

sequentially indexing each of the plurality of substantially identical metallic beverage container bodies to a printing site on the dry offset decorating apparatus;

engaging a circumferential side wall of the first metallic beverage container body with the first ink receiving surface of the first image transfer blanket and rotating the first metallic beverage container body circumferential side wall at least 6.6 radians while engaged with the first ink receiving surface and along a length of the first ink receiving surface greater than a circumferential length of the first metallic beverage container body circumferential side wall; and engaging a circumferential side wall of the second metallic beverage container body with the second ink receiving surface of the second image transfer blanket and rotating the second metallic beverage container body circumferential side wall at least 6.6 radians while engaged with the second ink receiving surface and along a length of the second ink receiving surface greater than a circumferential length of the second metallic beverage container body circumferential side wall.

2. The method of claim 1 wherein the first metallic beverage container body has a resultant decoration that is unique relative to a resultant decoration exhibited by the second metallic beverage container body subsequent to the two engaging and rotating steps.

3. The method of claim 2 wherein the rotating of the first and second metallic beverage container bodies for at least 6.6 rad is carried out while the first and second metallic beverage container bodies are engaged with ink-bearing portions of the first and second ink receiving surfaces, respectively.

4. The method of claim 3 wherein the first unique design element is spaced from the second design element on the first ink receiving surface such that rotation of the first metallic beverage container circumferential side wall by at least 6.2 radians against and along a length of the first ink receiving surface causes a first ink pattern associated with the first unique design element to be deposited on the first metallic beverage container side wall and causes a second ink pattern associated with the second unique design element to be deposited on the first metallic beverage container side wall and wherein the first ink pattern and the second ink pattern overlap.

5. The method of claim 4 wherein the third unique design element is spaced from the fourth design element on the second ink receiving surface such that rotation of the second metallic beverage container circumferential side wall by at least 6.2 radians against and along a length of the second ink receiving surface causes a third ink pattern associated with the third unique design element to be deposited on the second metallic beverage container side wall and causes a fourth ink pattern associated with the fourth unique design element deposited on the second metallic beverage container side wall and the third ink pattern and the fourth ink pattern overlap.

6. The method of claim 5 wherein the second and fourth ink patterns are defined by a surface area of the first image transfer blanket and the second image transfer blanket, respectively, having an absence of ink bounded by an identical common design element on each of the first image transfer blanket and the second image transfer blanket.

7. The method of claim 5 wherein the first and second image transfer blankets have an identical common design element on the first and second ink receiving surfaces, respectively, and which forms a boundary around the second and fourth unique design elements in low relief, respectively.

8. The method of claim 7 further comprising the steps of:

providing a plurality of ink applicators each supplied with a different color of ink;

providing a plurality of printing plates wherein each printing plate has a print surface in high relief;

engaging each of the plurality of ink applicators with a corresponding printing plate and transferring a quantity of ink thereto;

engaging each of the plurality of printing plates with the first ink receiving surface of the first image transfer blanket to provide a common ink pattern associated with the identical common design element and to provide ink to the first unique design element in high relief prior to the engaging a circumferential side wall of a first metallic beverage container body with the first ink receiving surface of the first image transfer blanket step;

repeating the engaging each of the plurality of ink applicators to each of the plurality of printing plates step; and engaging each of the plurality of printing plates with the second ink receiving surface of the second image transfer blanket to provide a common ink pattern associated with the identical common design element and to provide ink to the third unique design element in high relief prior to the engaging a circumferential side wall of a second metallic beverage container body with the second ink receiving surface of the second image transfer blanket step.

9. The method of claim 8 wherein the first and third ink patterns are defined by first and third ink pattern surface areas, respectively, and the second and fourth ink patterns are defined by second and fourth ink pattern areas, respectively, wherein the first and third ink pattern surface areas are located completely within boundaries of the second and fourth ink pattern surface areas, respectively.

10. The method of claim 8 wherein the first and third ink patterns are defined by first and third ink pattern surface areas, respectively, and the second and fourth ink patterns are defined by second and fourth ink pattern areas, respectively, and wherein the first and third ink pattern surface areas are less the second and fourth ink pattern surface areas, respectively.

11. The method of claim 8 wherein the first and third ink patterns are defined by first and third ink pattern surface areas, respectively, and the second and fourth ink patterns are defined by second and fourth ink patterns, respectively, and wherein the first and third ink pattern surface areas are greater than the second and fourth ink pattern surface areas, respectively.

12. The method according to claim 1 wherein the first and third unique design elements are alphanumeric characters.

13. The method according to claim 1 wherein the second and fourth unique design elements are alphanumeric characters.

14. The method according to claim 1 wherein the first unique design element is a same alphanumeric character as the second unique design element.

15. The method according to claim 1 wherein the third unique design element is a same alphanumeric character as the fourth unique design element.

16. A method comprising: consecutively decorating a plurality of substantially identical metallic beverage container bodies using a dry offset decorating apparatus without manufacturing interruption wherein each of the metallic beverage container bodies has an open end separated from a closed end by a circumferential side wall by over-rotating first and second metallic beverage container bodies 6.6 radians against lengths of first and second ink receiving surfaces on first and second image transfer blankets, respectively, which are greater than circumferential lengths of each of the metallic beverage container bodies, wherein a first metallic beverage container body first engages an ink-bearing leading edge of a first unique design element in high relief and wherein a first edge of the first unique design element is separated from a first edge of a common design element on the first ink receiving surface by a low relief portion of the first ink receiving surface and wherein the first metallic beverage container body further engages an ink-bearing portion of the first ink receiving surface comprising the common design element thereon, and wherein a second unique design element on the first ink receiving surface is in low relief between the first edge of the common design element and the first edge of the unique design element, wherein a first art associated with the first unique design element overlies a second art associated with the second design element and the first art is located completely within a surface area of the second art.

17. The method of claim 8 wherein the first and third ink patterns are defined by first and third ink pattern surface areas, respectively, and the second and fourth ink patterns are defined by second and fourth ink pattern areas, respectively, and wherein the first and third ink pattern surface areas are substantially equal to the second and fourth ink pattern surface areas, respectively.

* * * * *